US010646390B2

(12) United States Patent
Clenet et al.

(10) Patent No.: US 10,646,390 B2
(45) Date of Patent: May 12, 2020

(54) METHOD AND STRUCTURE FOR LIGHTWEIGHT INTEGRALLY FORMABLE BED FRAMES FOR ARTICULATING BEDS

(71) Applicant: Ergomotion, Inc., Santa Barbara, CA (US)

(72) Inventors: Alain Clenet, Santa Ynez, CA (US); Joey Krueger, Goleta, CA (US)

(73) Assignee: ergomotion, inc., Goleta, CA (US)

( * ) Notice: Subject to any disclaimer, the term of this patent is extended or adjusted under 35 U.S.C. 154(b) by 1023 days.

(21) Appl. No.: 14/712,520

(22) Filed: May 14, 2015

(65) Prior Publication Data

US 2016/0331612 A1 Nov. 17, 2016

(51) Int. Cl.
*A61G 7/015* (2006.01)

(52) U.S. Cl.
CPC ..... *A61G 7/015* (2013.01)

(58) Field of Classification Search
CPC ..... A47C 27/085; A47C 31/003; A47C 20/08; A47C 20/00; A47C 19/02; A47C 19/021; A47C 19/025; A47C 19/005; A61G 7/015; A61G 7/002; F16B 12/54; F16B 12/60
See application file for complete search history.

(56) References Cited

U.S. PATENT DOCUMENTS 1,463,161 A * 7/1923 Gale ..... A47C 19/021 5/206
2,541,194 A * 2/1951 Bornhuetter ..... A47C 19/005 248/544
2,701,372 A 2/1955 Hillenbrand
3,188,664 A * 6/1965 Goldberg ..... F16B 12/52 5/181
3,266,635 A * 8/1966 McConnell ..... A47B 57/402 211/187
3,463,325 A * 8/1969 Rogers ..... A47B 57/00 211/187
3,590,754 A * 7/1971 Jakobsen ..... A47B 13/083 108/161
3,950,797 A * 4/1976 Bronstien, Jr. ..... A47C 23/05 5/200.1
4,103,375 A * 8/1978 Santo ..... A47B 95/00 312/204
4,155,131 A * 5/1979 Harris ..... A47C 19/005 312/263
4,169,294 A * 10/1979 Harris ..... A47C 19/021 5/200.1
4,196,484 A * 4/1980 Harris ..... A47C 19/025 5/201
4,354,287 A 10/1982 Fredman
(Continued)

*Primary Examiner* — Peter M. Cuomo
*Assistant Examiner* — Ifeolu A Adeboyejo
(74) *Attorney, Agent, or Firm* — Felix L. Fischer

(57) ABSTRACT

An articulating bed frame incorporates an extruded metal frame shape which is formed into any desired bed size by slicing of kerfs in the extrusion for side lengths with bending at the kerfs around sized base plate elements to create the completed frame. The frame employs an extruded beam having an inner flange and a support channel formed therein. The extruded beam is cut to form frame side elements and end elements and a plurality of support blocks are received in and support by the support channel. The support blocks engage a cradle supporting a seat section of an articulating structure.

15 Claims, 34 Drawing Sheets

(56) References Cited

U.S. PATENT DOCUMENTS 4,675,928 A * 6/1987 Fisher ..... A47C 27/085 5/193
4,729,137 A * 3/1988 Denney ..... A47C 29/003 135/121
4,768,661 A * 9/1988 Pfeifer ..... A47F 5/005 211/184
4,878,259 A * 11/1989 Lupo ..... A47C 19/02 5/675
4,955,490 A * 9/1990 Schafer ..... A47B 57/581 211/187
5,012,538 A * 5/1991 Timm ..... A47C 19/005 5/200.1
5,070,556 A * 12/1991 Gloger ..... A47C 17/86 16/35 R
5,579,550 A * 12/1996 Bathrick ..... A47C 19/005 5/184
5,996,145 A 12/1999 Taylor
6,276,011 B1 * 8/2001 Antinori ..... A47C 20/041 5/613
6,990,698 B2 * 1/2006 Wall, Sr. ..... A47C 19/005 5/618
7,810,189 B2 * 10/2010 Boudreau ..... A47C 19/021 5/308
8,091,165 B2 * 1/2012 Mossbeck ..... A47C 20/041 5/200.1
9,167,908 B1 * 10/2015 Anthony ..... A47C 19/02
9,375,102 B2 * 6/2016 Troyner ..... A47B 47/021
9,744,088 B2 * 8/2017 Shih ..... A61G 7/018
2005/0039258 A1 * 2/2005 Gavela Vazquez .. A47C 19/005 5/400
2005/0125899 A1 6/2005 Hanson
2006/0112485 A1 * 6/2006 Harrow ..... A47C 19/005 5/201
2011/0247138 A1 10/2011 Clenet
2013/0117932 A1 * 5/2013 Stewart ..... A47C 19/025 5/400
2018/0125252 A1 * 5/2018 Chung ..... A47C 19/005

* cited by examiner

METHOD AND STRUCTURE FOR LIGHTWEIGHT INTEGRALLY FORMABLE BED FRAMES FOR ARTICULATING BEDS

REFERENCE TO RELATED APPLICATIONS

This application claims the priority of U.S. Provisional application Ser. No. 61/993,087 filed on May 14, 2014, the disclosure of which is incorporated herein by reference.

BACKGROUND

Field

This invention relates generally to the field of adjustable beds and more particularly to a structure for the frame of an articulating bed having an extruded support frame with integral elements for bolster attachment and articulating elements support engagement.

Description of the Related Art

Articulating beds are becoming increasingly popular and are being produced in a number of sizes and styles. Assembled wood and/or metal frames are typically employed to support the articulating elements of the bed. Varying frame sizes for twin, queen, king, super king and separated king beds are required and typically must be individually tooled for fabrication resulting in numerous part numbers. Welding or heavy mechanical fasteners are required for assembly and the weight of the assembled bed may be significant.

It is therefore desirable to provide a frame for an articulating bed which is easily fabricated with minimal tooling, use of simple fasteners and reduction of separate part number assembly elements.

SUMMARY

The embodiments disclosed herein overcome the shortcomings of the prior art by providing an extruded metal frame shape which is formed into any desired bed size by slicing of kerfs in the extrusion for side lengths with bending at the kerfs around sized base elements to create the completed frame. The frame for an articulating bed employs an extruded beam having an inner flange and a support channel formed therein. The extruded beam is cut to form frame side elements and end elements and a plurality of support blocks are received in and support by the support channel. The support blocks engage a cradle supporting a seat section of an articulating structure.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1A:
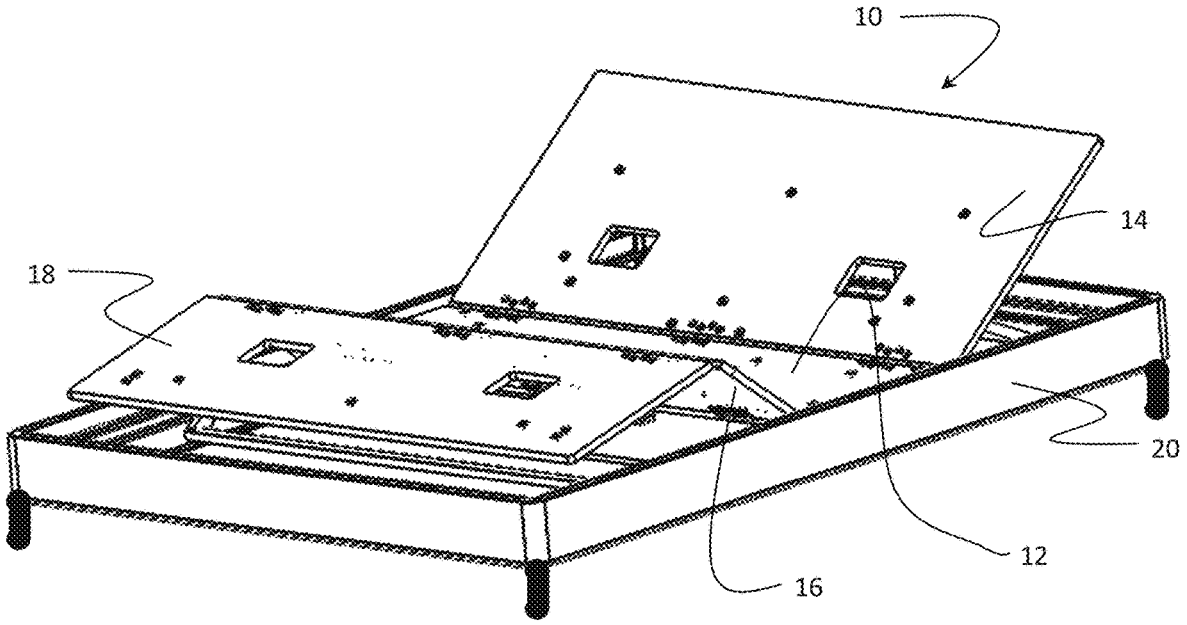
FIG. 1A is an upper perspective view of the articulating bed employing the frame embodiments described herein.

Embodiments shown in the drawings and described herein provide a structure and system for fabrication of an articulating bed frame structure allowing linear manufacturing processes with minimal labor and tooling. The frame elements are self-jigging for assembly and are adaptable to a range of sizes.

Figure 1B:
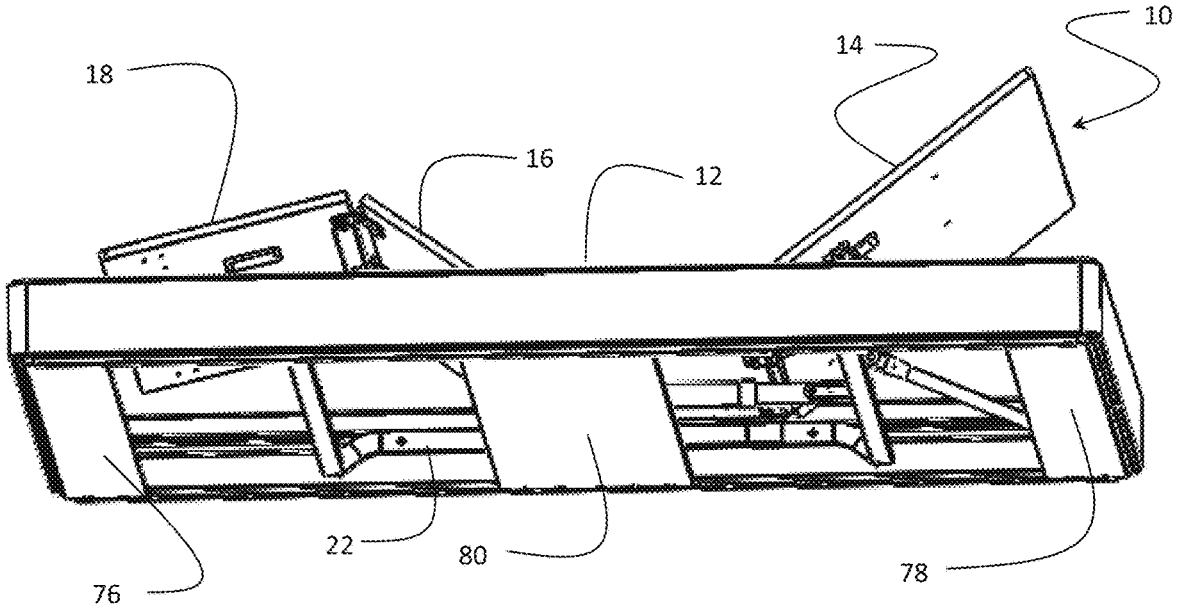
FIG. 1B is a lower perspective view of the bed of FIG. 1A.

Referring to the drawings, FIG. 1A shows an articulating bed employing a structural frame as disclosed herein. The articulating structure 10 has a seat support 12, an upper body support element 14, a thigh support element 16, the upper body support element and thigh support element attached to the seat support element with hinges, and a lower leg support element 18 attached with hinges to the thigh support element. The support elements are shown as substantially solid however, rigid honeycomb or similar material providing a rigid planar surface may be employed. A frame 20 supports the articulating structure 10. As shown in FIG. 1B, a chariot 22 is engaged to the seat support 12 and carries the articulating structure 10 allowing a "wall hugging" effect with the upper body support element 14. The chariot 22 traverses longitudinally (from foot to head of the bed) as the upper body support element 14 is elevated from a flat to upright position.

Figure 2A:
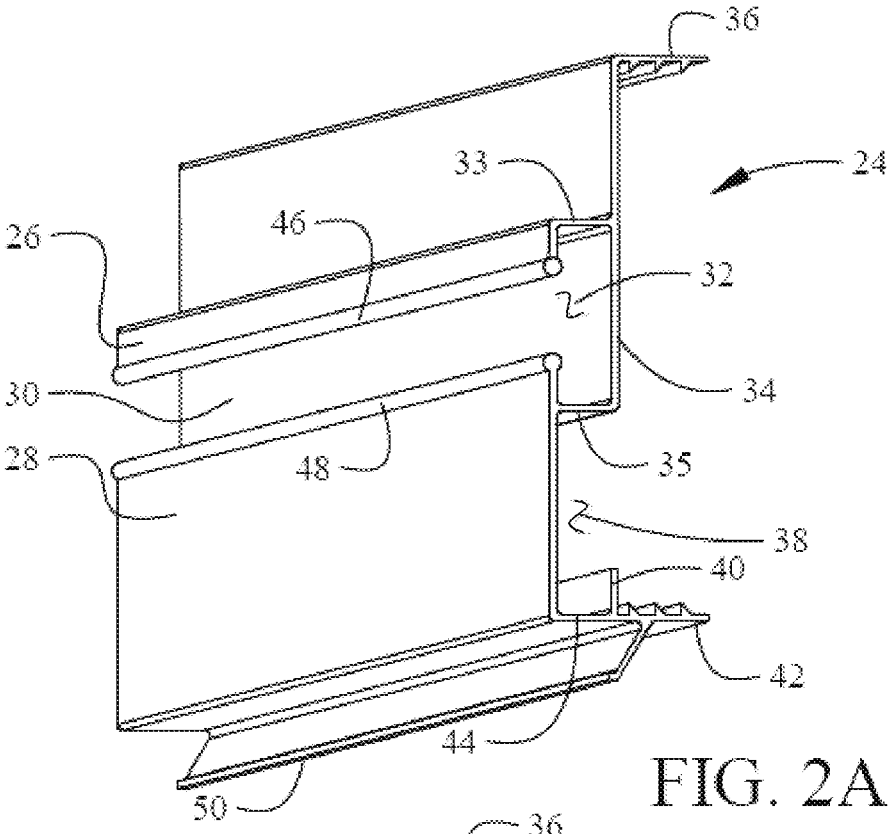
FIG. 2A is a perspective view of a first exemplary structural frame extrusion for a first exemplary frame embodiment as described herein.
Figure 2B:
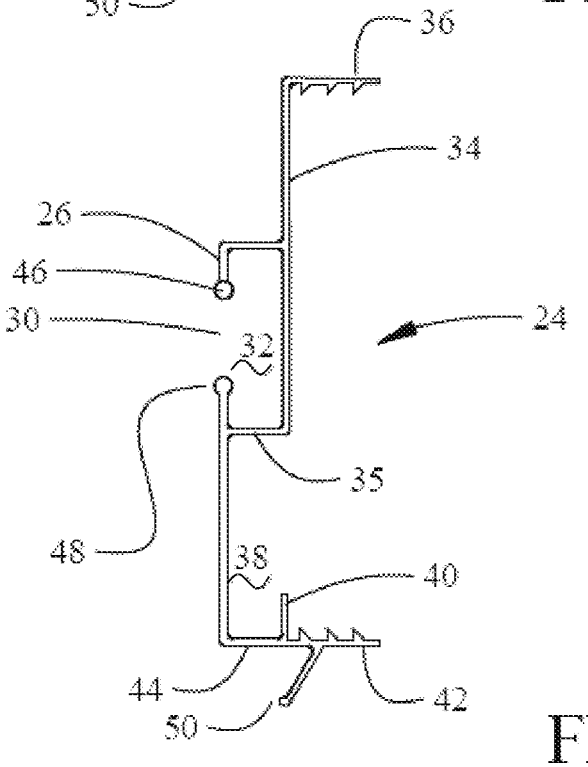
FIG. 2B is an end view of the first exemplary structural frame extrusion.

The frame 20 is formed from an extruded beam 24 shown in FIGS. 2A and 2B. The extruded beam 24, which may be metal or other structural material and, for the embodiments disclosed herein is aluminum, incorporates an upper inner flange 26 and a lower inner flange 28 separated by a slot 30 which opens into a support channel 32 having an upper wall 33 and a lower wall 35. An upper outer flange 34 closes the support channel 32 and extends upward to an upper gripping flange 36. An accessory channel 38 is backed by the lower inner flange 28 and a lower outer flange 40 provides partial closure of the exterior of the accessory channel 38. Wiring for articulation system actuators, integral massage systems, audio or lighting systems associated with the bed may be routed through the accessory channel. In alternative embodiments, the lower outer flange may provide total exterior closure of the accessory channel. A lower gripping flange 42 extends from a bottom flange 44 which also forms a bottom wall of the accessory channel 38. The support channel lower wall 35 provides the upper termination of the accessory channel 38 for the embodiment shown in the drawings. The lower edge of upper inner flange 26 and upper edge of lower inner flange 28 terminate in an upper runner bead 46 and lower runner bead 48, respectively, which bound the slot 30 in the exemplary embodiment. A feeler flange 50 depends from the bottom flange 44.

Figure 2C:
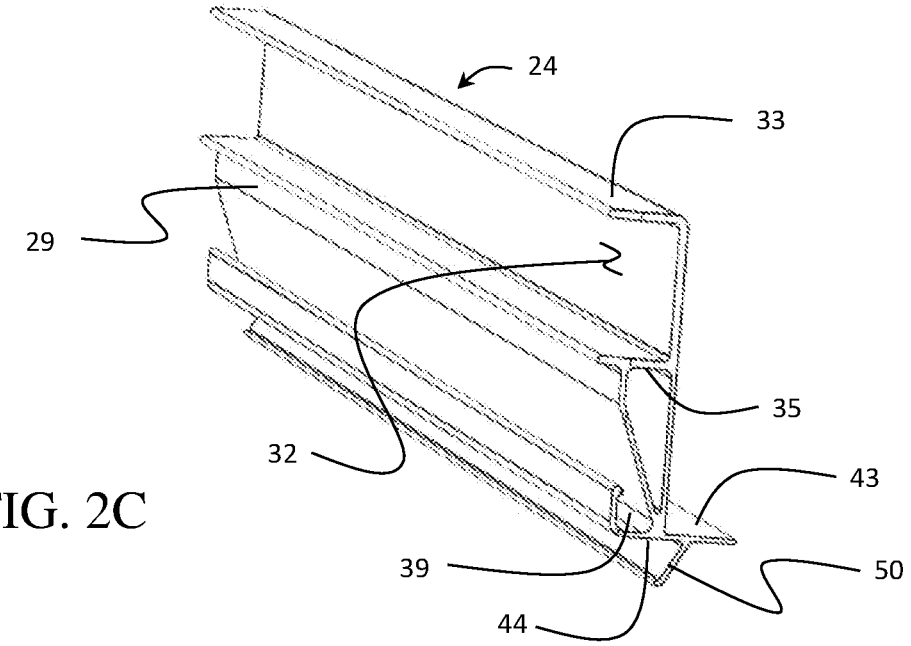
FIG. 2C is a perspective view of a second exemplary structural frame extrusion for a second exemplary frame embodiment as described herein.
Figure 2D:
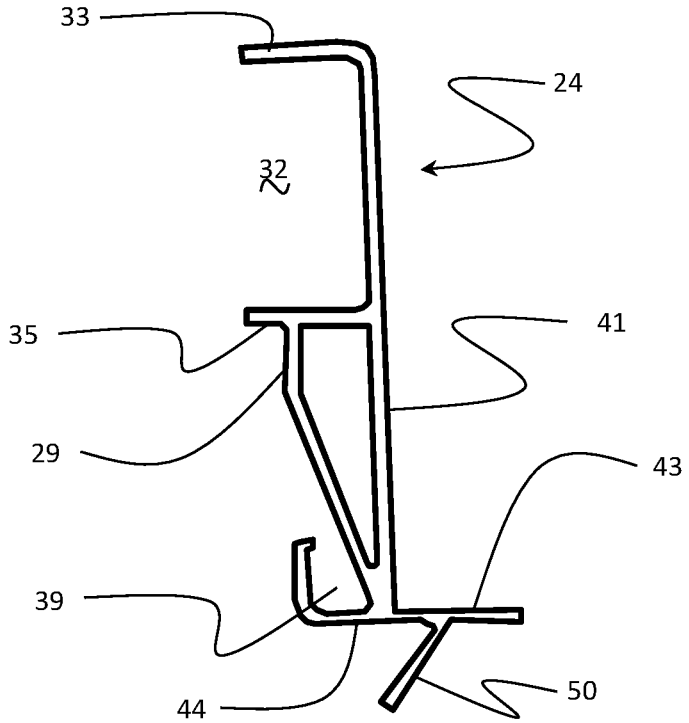
FIG. 2D is an end view of the second exemplary structural frame extrusion.

Alternative configurations of the extrusion may be employed for other desired embodiments. FIGS. 2C and 2D show a first alternative for use with an embodiment to be described in greater detail subsequently wherein the extruded beam 24 terminates at the upper wall 33 of the support channel 32 and does not incorporate an upper gripping flange. Lower wall 35 extends from the upper outer flange 34 which closes the support channel 32. Lower wall 35 is supported by an inner flange 29. A lower outer flange 41 extends downward from the support channel 32 and terminates in a bottom flange 44. A lower flange 43 is present which extends from the bottom flange 44 and feeler flange 50 depends from the bottom flange 44 as in the prior embodiment. An accessories channel 39 is provided.

Figure 3A:
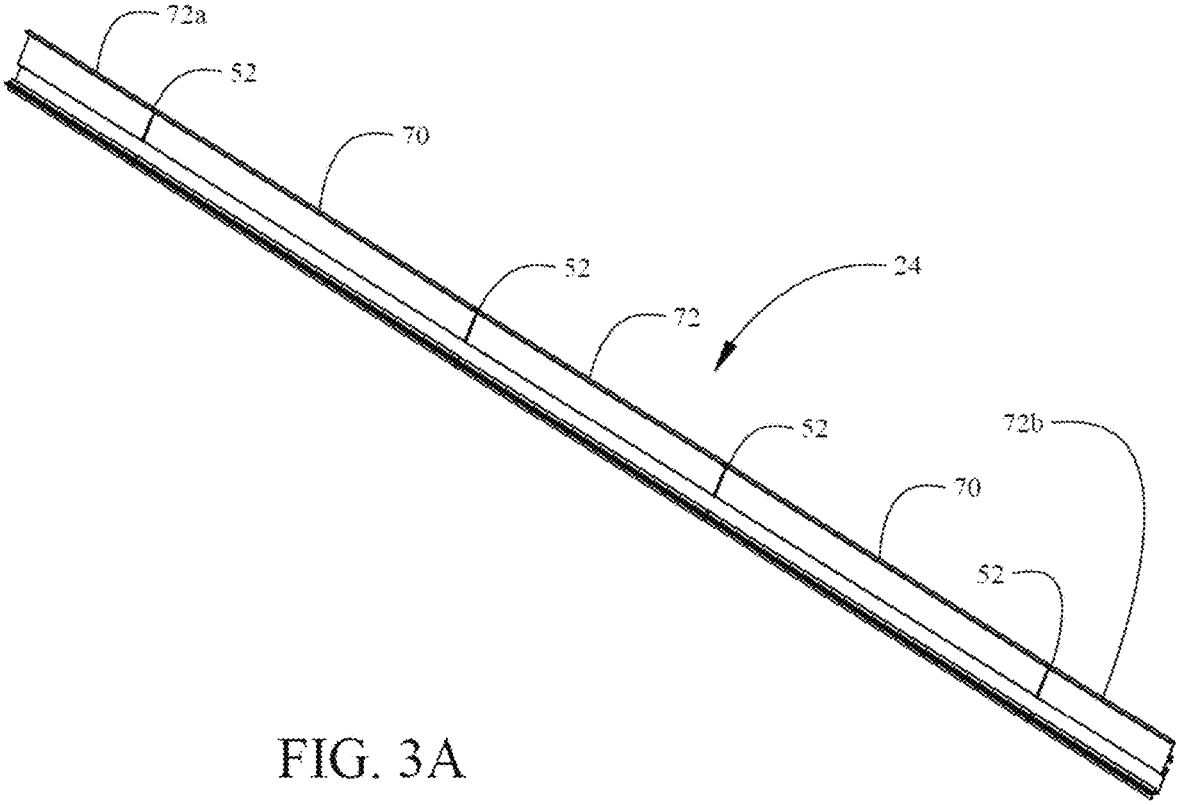
FIG. 3A is a perspective view of the first structural frame extrusion showing saw kerfs defining the length and width of side elements and end elements of the frame.
Figure 3B:
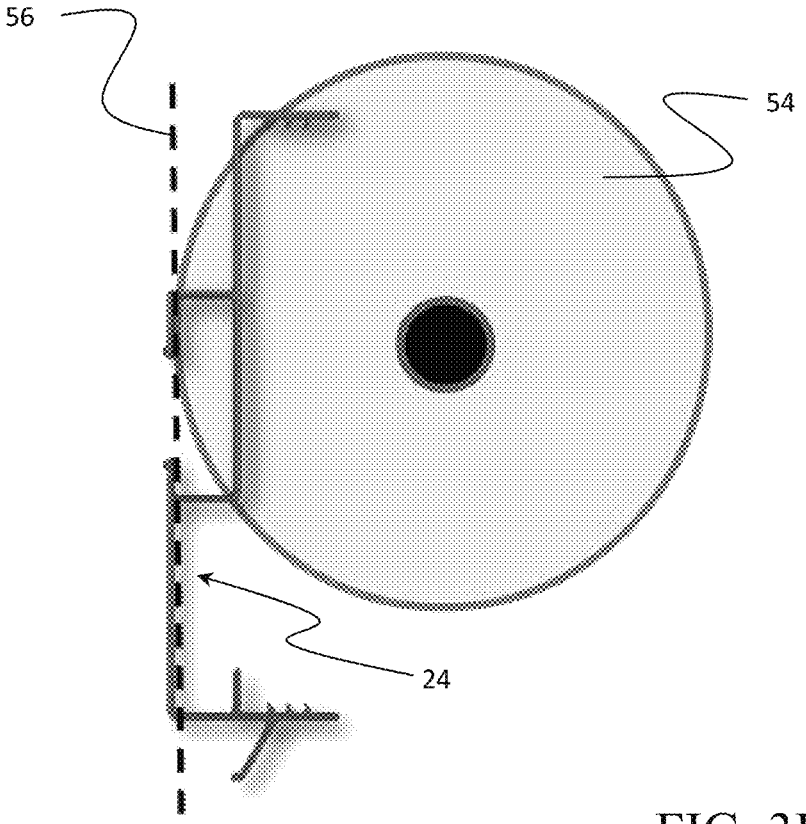
FIG. 3B is an end view of the first structural frame extrusion showing a saw blade creating a kerf for bending of the frame.
Figure 4A:
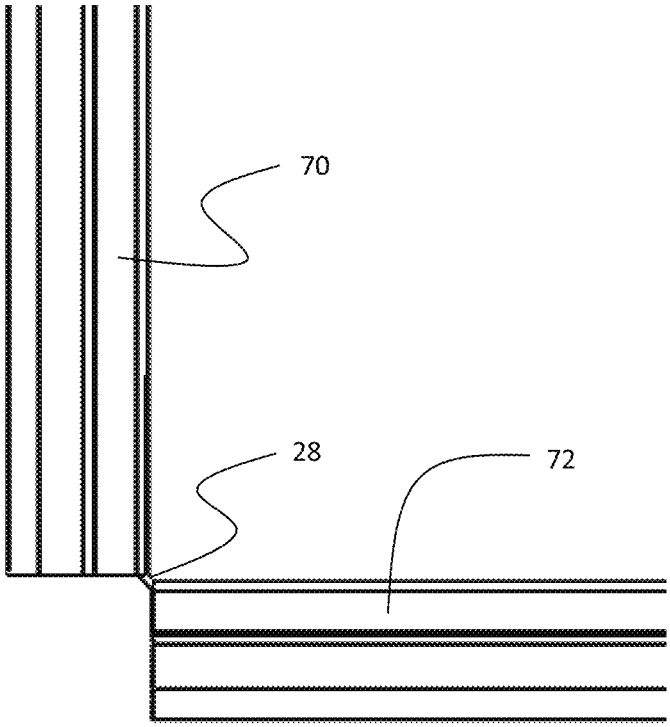
FIG. 4A is a partial top view of a corner of the bent frame.
Figure 4B:
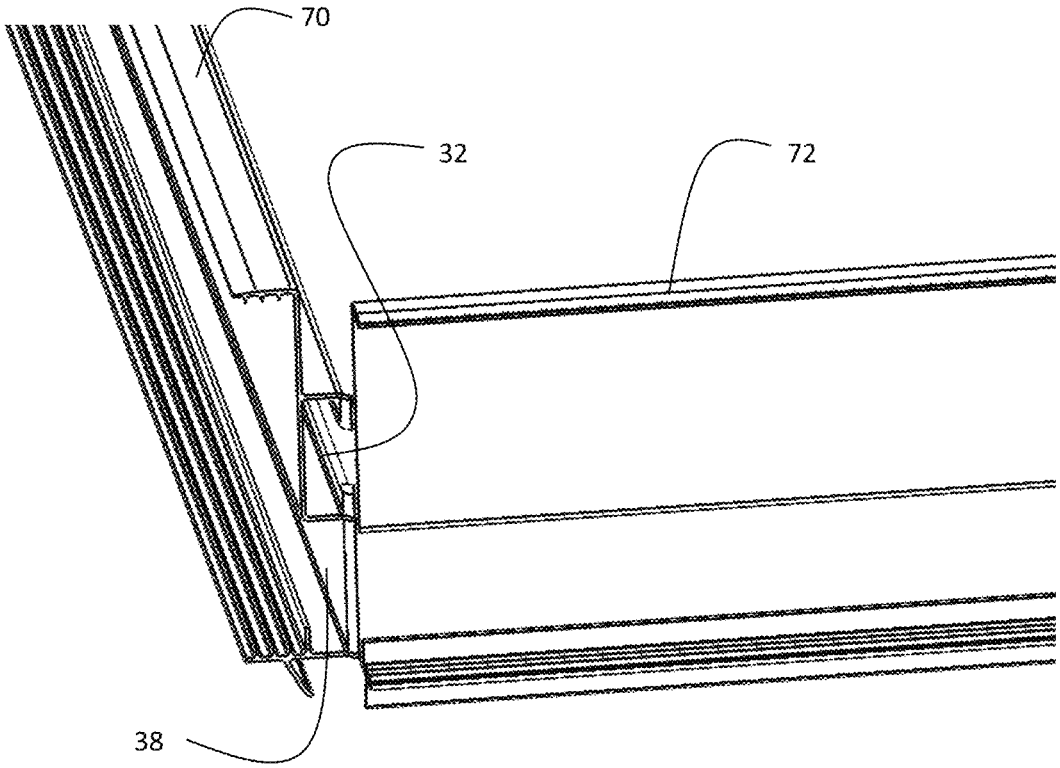
FIG. 4B is a partial perspective view of a corner of the bent frame.

The configuration of the extruded beam 24 described with respect to FIGS. 2A and 2B allows the creation of saw kerfs 52 for defining the length and width of side elements 70 and end elements 72 and 72*a*, 72*b* of the frame 10 as shown in FIG. 3A. As shown in FIG. 3B, a saw blade 54 is employed to provide precision cuts of the extruded beam 24 extending to line 56 through the upper gripping flange 36, upper outer flange 34, support channel upper wall 33 and lower wall 35, lower outer flange 40, lower gripping flange 42, accessory channel bottom wall 44 and feeler flange 50 leaving only the web of inner upper flange 26 and lower inner flange 28 intact as the termination of the kerf 52. The extruded beam 24 may then be bent at each kerf as shown in FIGS. 4A and 4B to form the frame 10 as will be described in greater detail subsequently. As seen in FIG. 4B, the bends at the kerf position the support channel 32 on the interior of the frame 10 and the accessory channel 38 on the exterior of the frame. The support channel 32 in each element of the frame is accessible from the open ends created at the kerf for assembly operations as will be described in greater detail subsequently. Similarly, the accessory channel is open at the ends.

Figure 5:
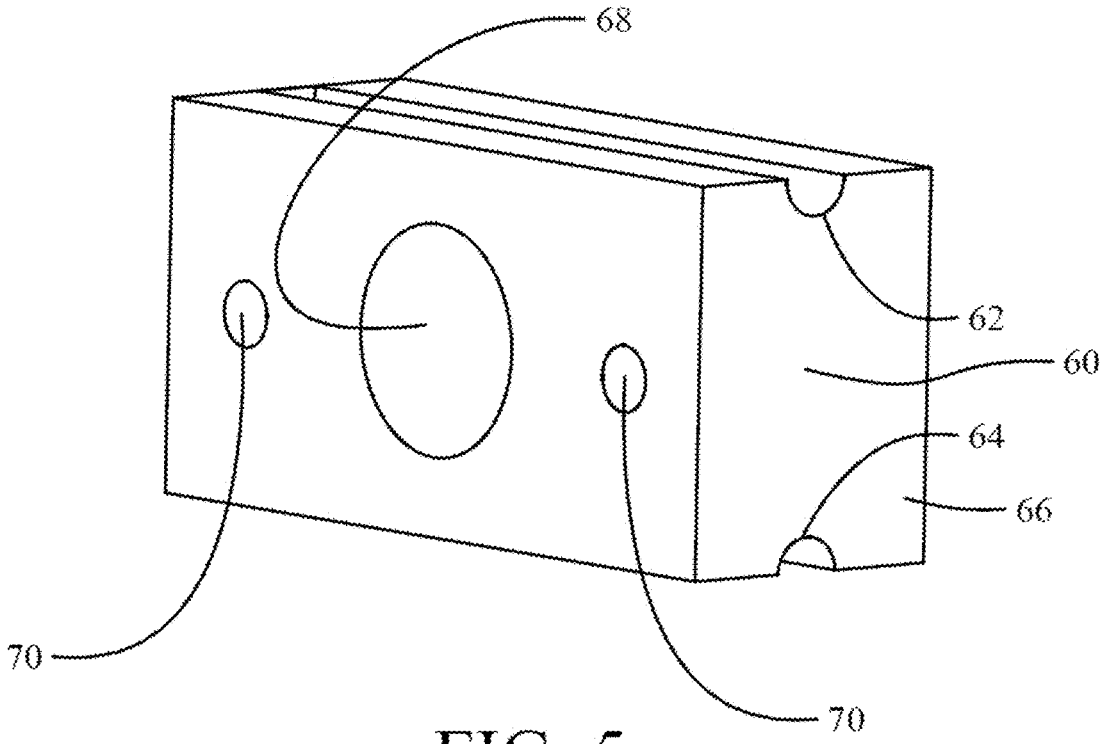
FIG. 5 is a perspective view of an example slider for mounting in the support channel in the frame.
Figure 6A:
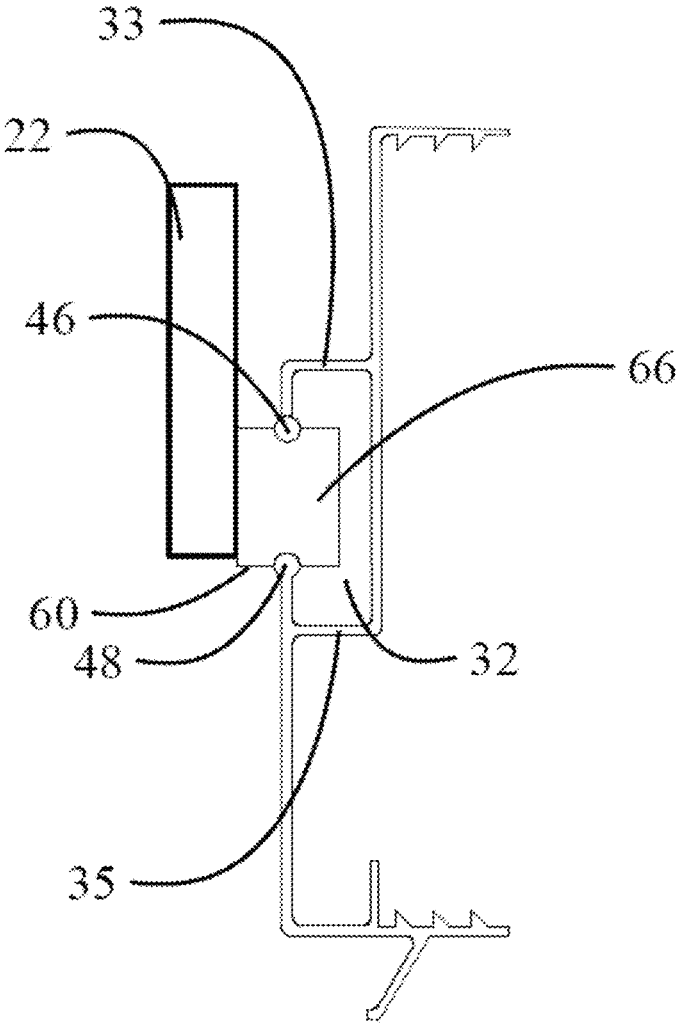
FIG. 6A is an end view of the first structural frame extrusion showing the slider mounted in the support channel.
Figure 6B:
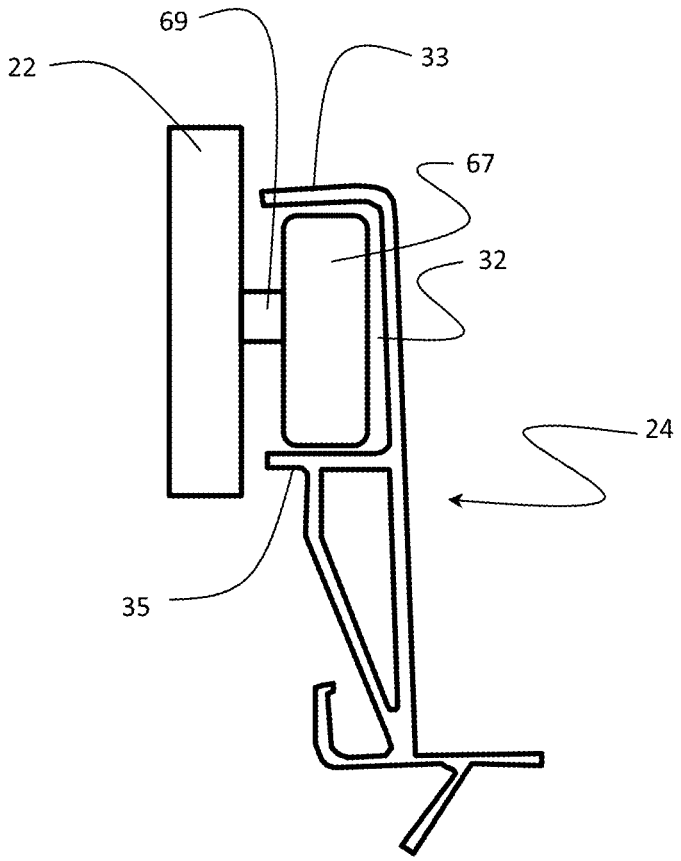
FIG. 6B is an end view of the second structural frame extrusion showing a wheeled support mounted in the support channel.
Figure 7A:
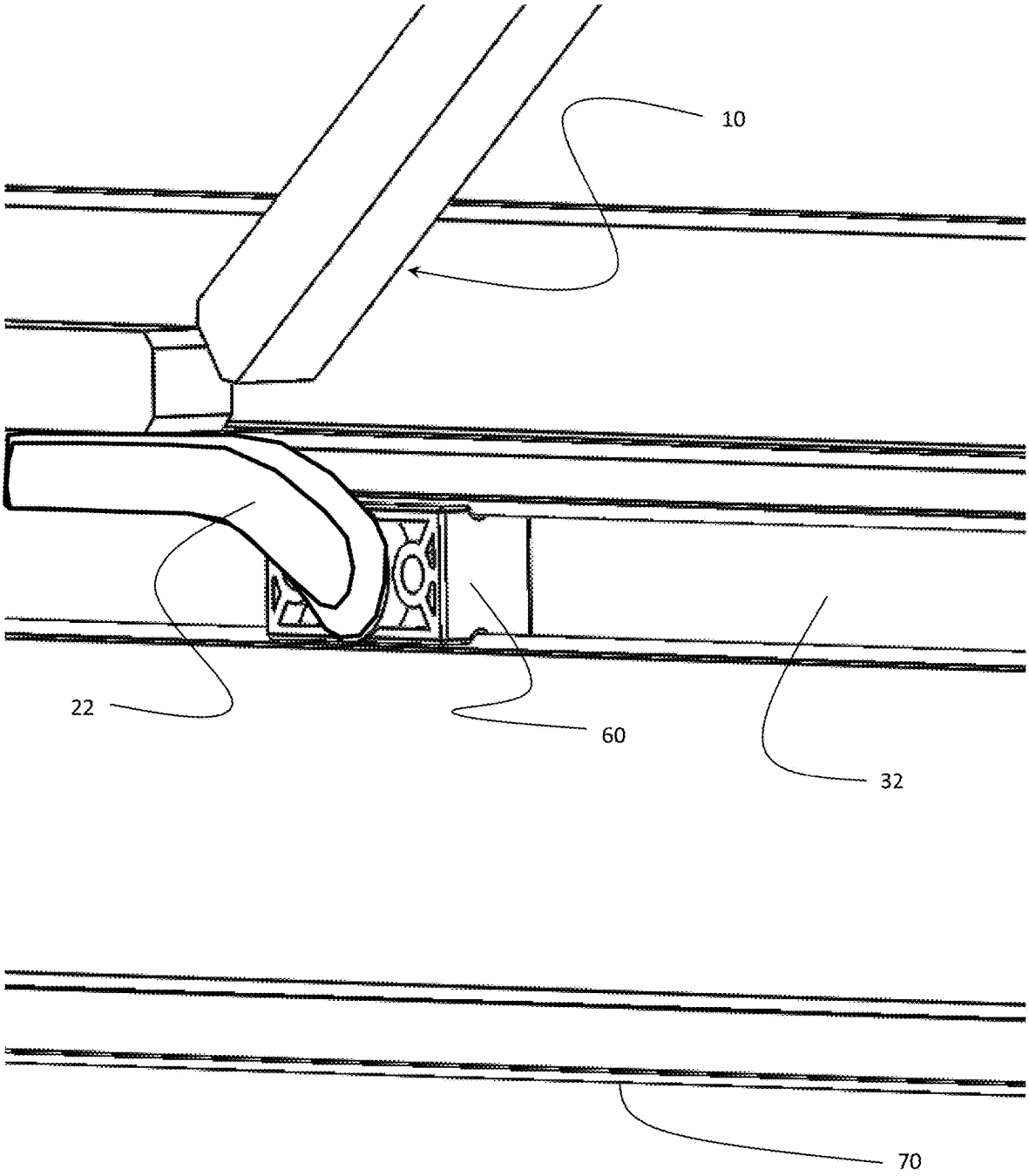
FIG. 7A is a partial perspective detail view showing the slider in the support channel with exemplary positioning of the seat board and upper body boards as relatively positioned on the chariot.
Figure 7B:
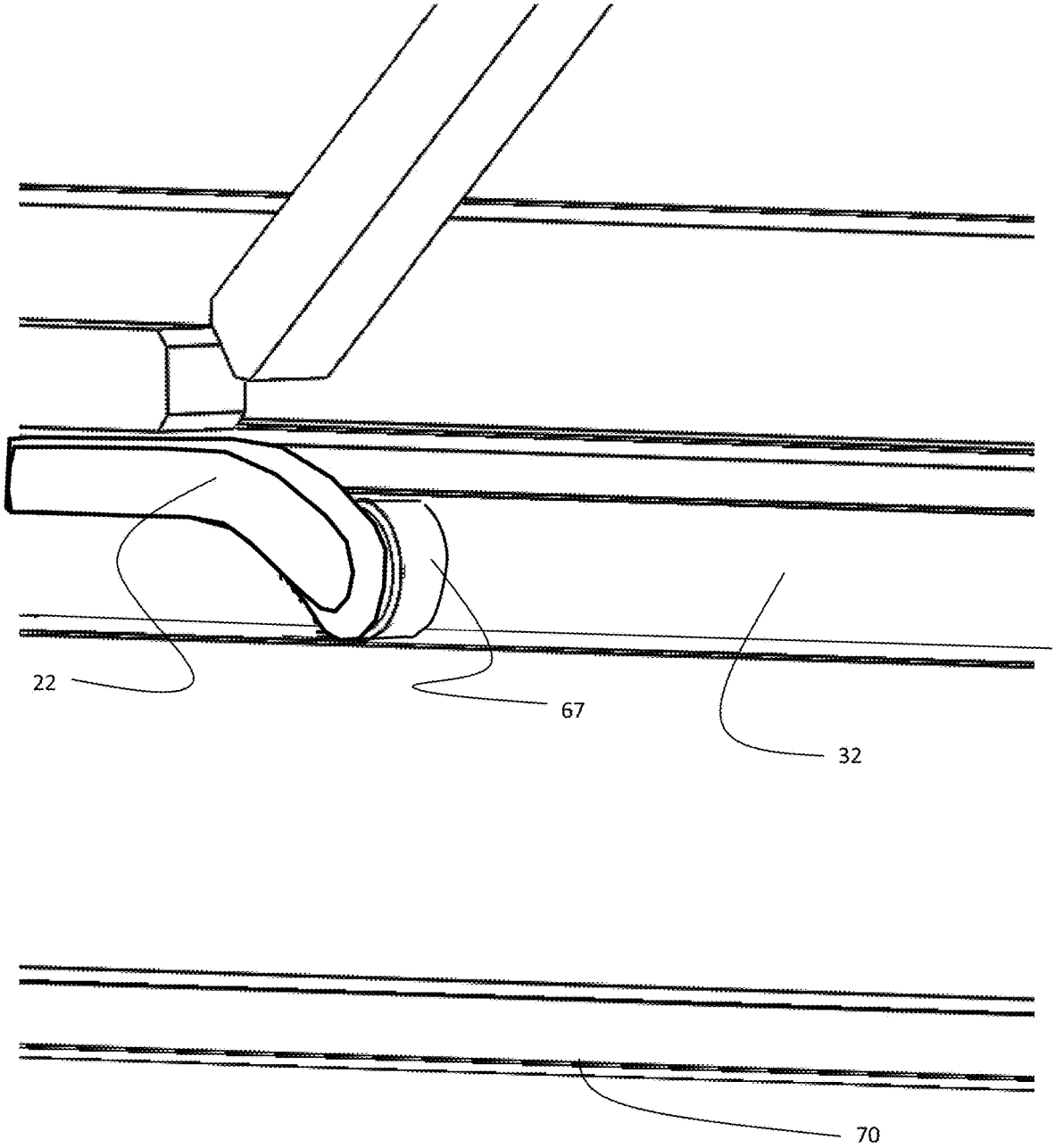
FIG. 7B is a partial perspective detail view showing a wheeled support for the chariot in the support channel with exemplary positioning of the seat board and upper body boards as relatively positioned on the chariot.
Figure 8:
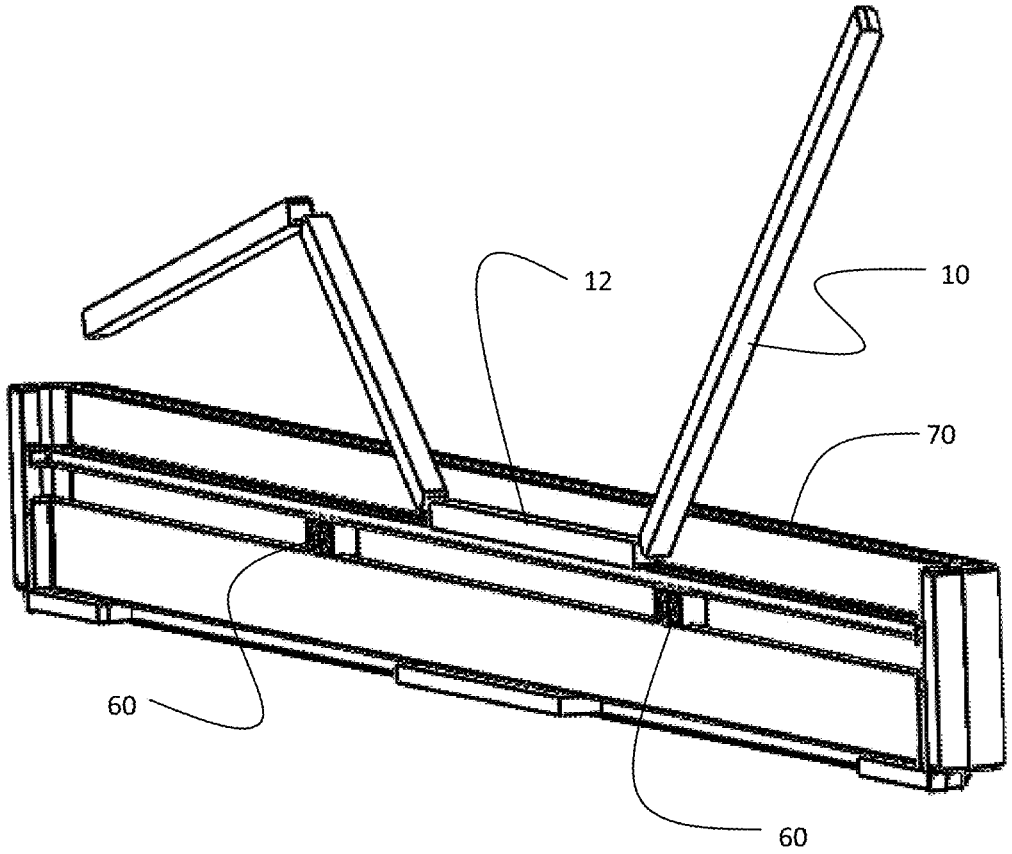
FIG. 8 a section perspective view showing example sliders in the support channel with relative positioning of the articulating elements of the mattress support.
Figure 9:
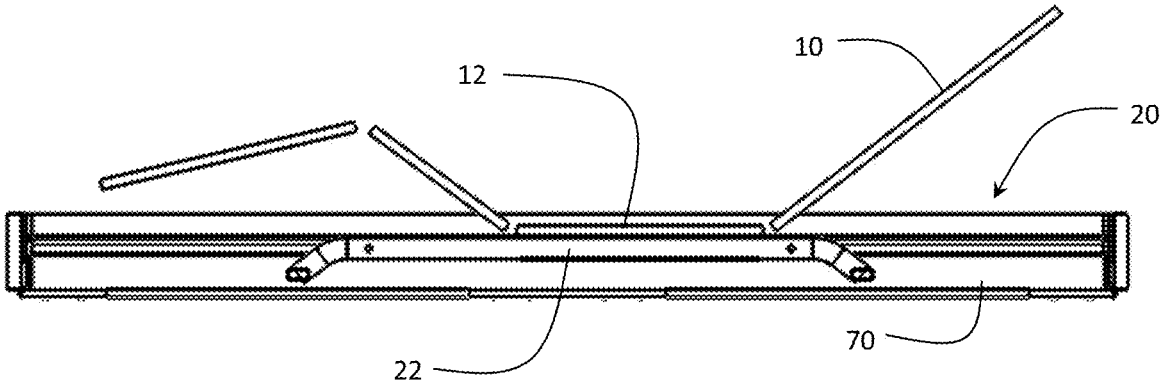
FIG. 9 is a side section view showing the chariot supporting the articulating structure.

The chariot 22 supporting the articulating structure 10 as described with respect to FIG. 1B, engages support elements riding in the support channel 32 such as translating support blocks 60 shown in detail in FIG. 5. Each translating support block 60 has an upper groove 62 and lower groove 64 which are adapted to engage and ride on the upper and lower runner beads 46, 48 with an inner portion 66 of the translating block 60 engaged within the support channel 32 as shown in FIGS. 6A and 7A. A central bore 68 receives an axle extending from the chariot 22. Subsidiary bores 70 may be employed for attachment fasteners. The translating support block 60 is formed from naturally lubricious material such as nylon or Teflon® to allow easy translation along the runner beads and support channel during translation of the chariot 22 during operation of the articulating structure 10. As shown in FIGS. 8 and 9, a pair of translating support blocks 60 riding in the support channels 32 of side elements 70 engage the chariot 22 in spaced relation providing support for the articulating structure 10. In alternative embodiments the translating blocks may ride on the bottom 35 of support channel 32 or the support elements may be wheels 67 or similar structure with an axle 69 from the chariot 22 which may be received within the support channel 32 as shown in FIG. 6B to engage and support the chariot for translating motion. The alternative configuration of the extrusion 24 as described with respect to FIGS. 2C and 2D is shown for this alternative embodiment. The resulting carriage arrangement is shown in FIG. 7B.

Figure 10A:
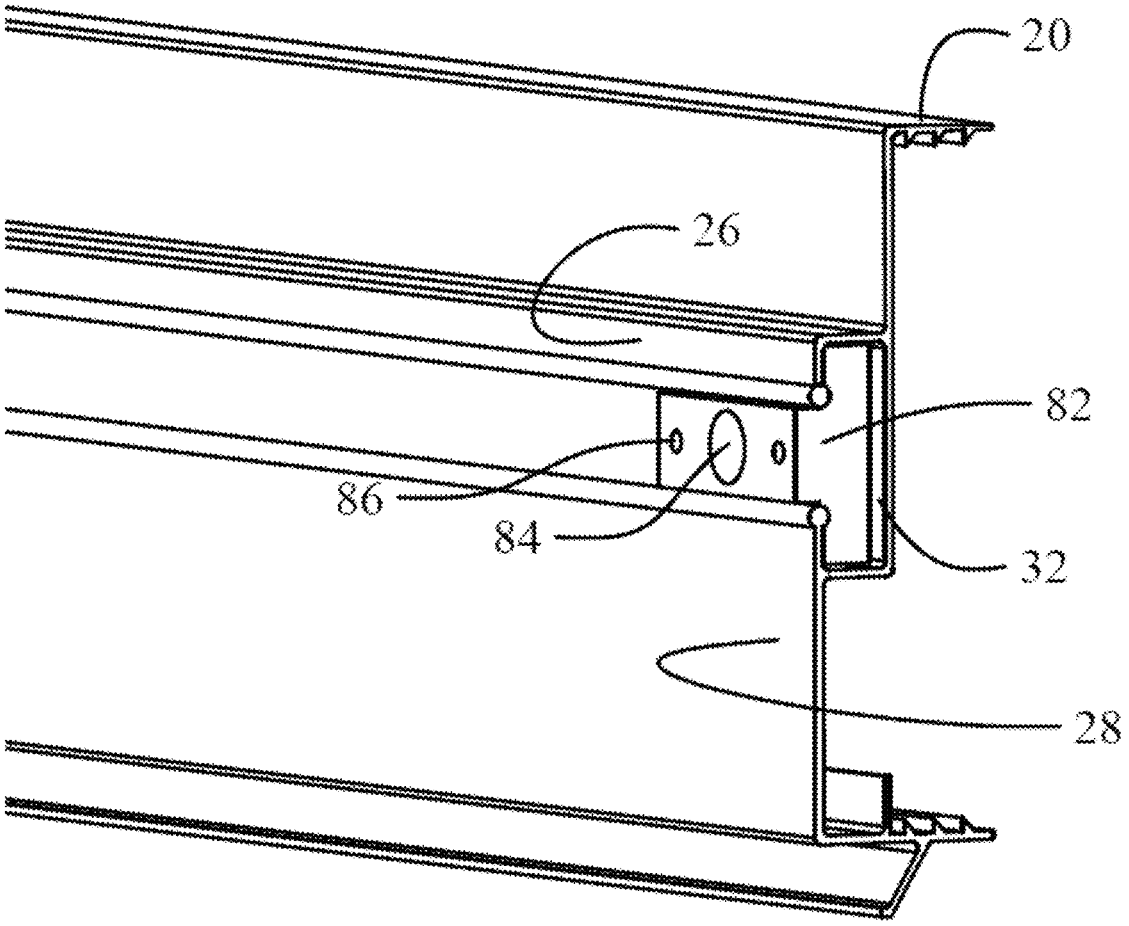
FIG. 10A is a perspective view of a locked support block in the support channel.

Various articulation mechanisms may be employed with the frame structure in the disclosed embodiments. A head end plate 76, foot end plate 78 and central plate 80 are employed as a portion of the frame 20 for additional rigidity and for integrated fabrication forms as will be described in greater detail subsequently. Peripheral edges of the end plates and the side edges of the central plate are engaged by the feeler flange in the extruded beam. Actuators and tension or compression elements for the articulation mechanisms may be mounted to the plates or may be engaged by stationary or locked support blocks 82 received in the support channel 32 as shown in FIG. 10A. The locked support blocks incorporate engagement bores 84 to receive axles to engage the articulation elements and may include fixation bores 86. The locked support blocks 82 may be engaged to be secured in a predetermined location in the support channel by fasteners match drilled through the upper or lower inner flanges 26, 28, broad headed fasteners inserted in the fixation bores 86 to engage one or both of the upper and lower inner flanges 26, 28 or set screws inserted through the fixation bores 86 to dimple and engage the back surface of the support channel, or peened dimples created in the flanges of the support channel to secure the locked support blocks.

Figure 10B:
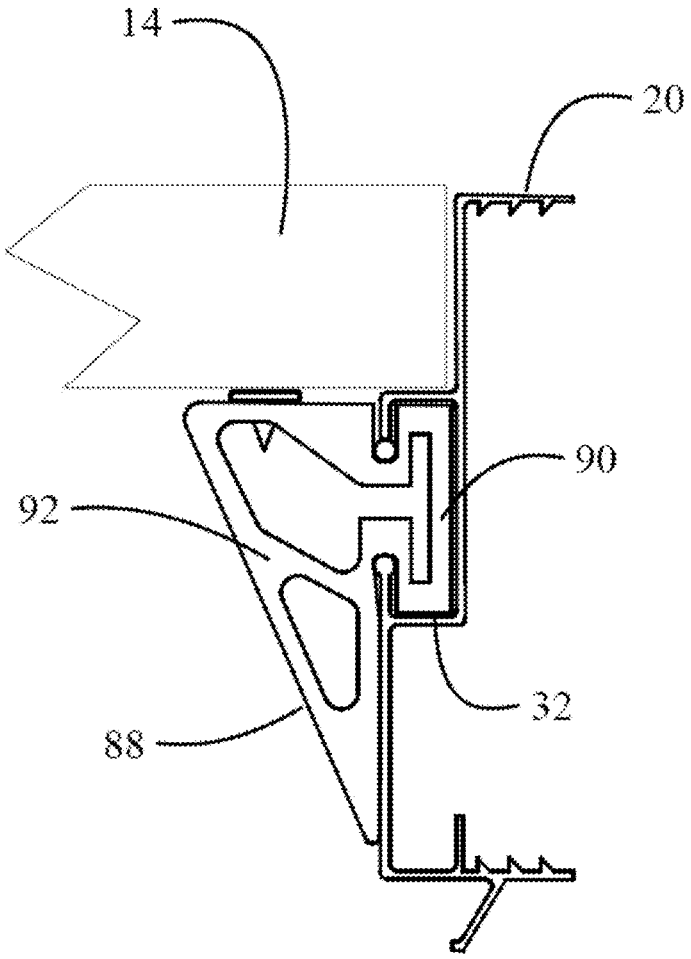
FIG. 10B is an end section view of the structural frame extrusion with an angled support member for the articulating support boards inserted in the support channel.

Additional support elements such as angled support members 88, as seen in FIG. 10B, may be received at predetermined positions in the support channels 32. The angled support member 88 includes a body 90 received in the support channel 32 and an angled extension 92 protruding through slot 30 to provide additional support for an articulating support element such as upper body support element 14 in the unarticulated position flush with the frame 20.

The angled support member has sufficient length to span a joint between abutting extruded beam elements such as the end closure elements 72*a* and 72*b* as previously described.

Figure 11A:
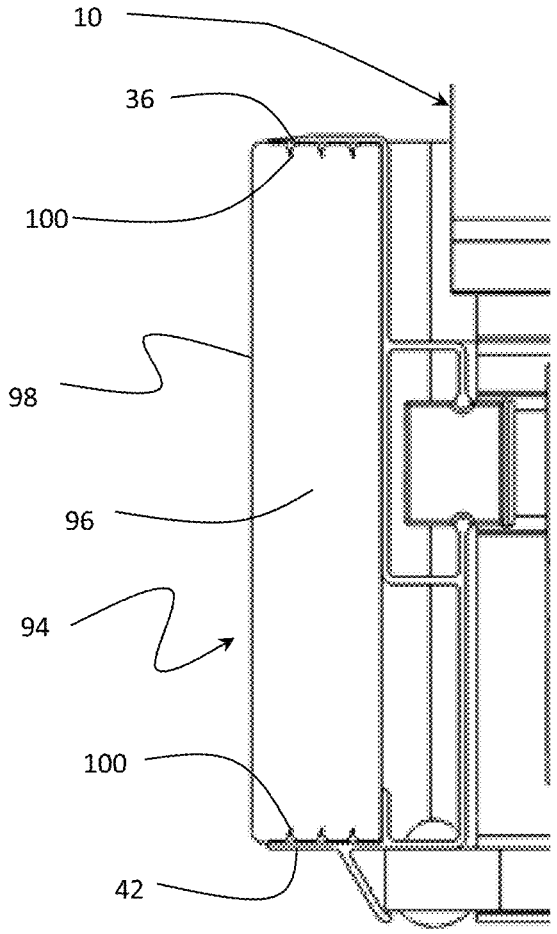
FIG. 11A is an end section view showing the first structural frame extrusion with a foam bolster element inserted in the bolster flanges.
Figure 11B:
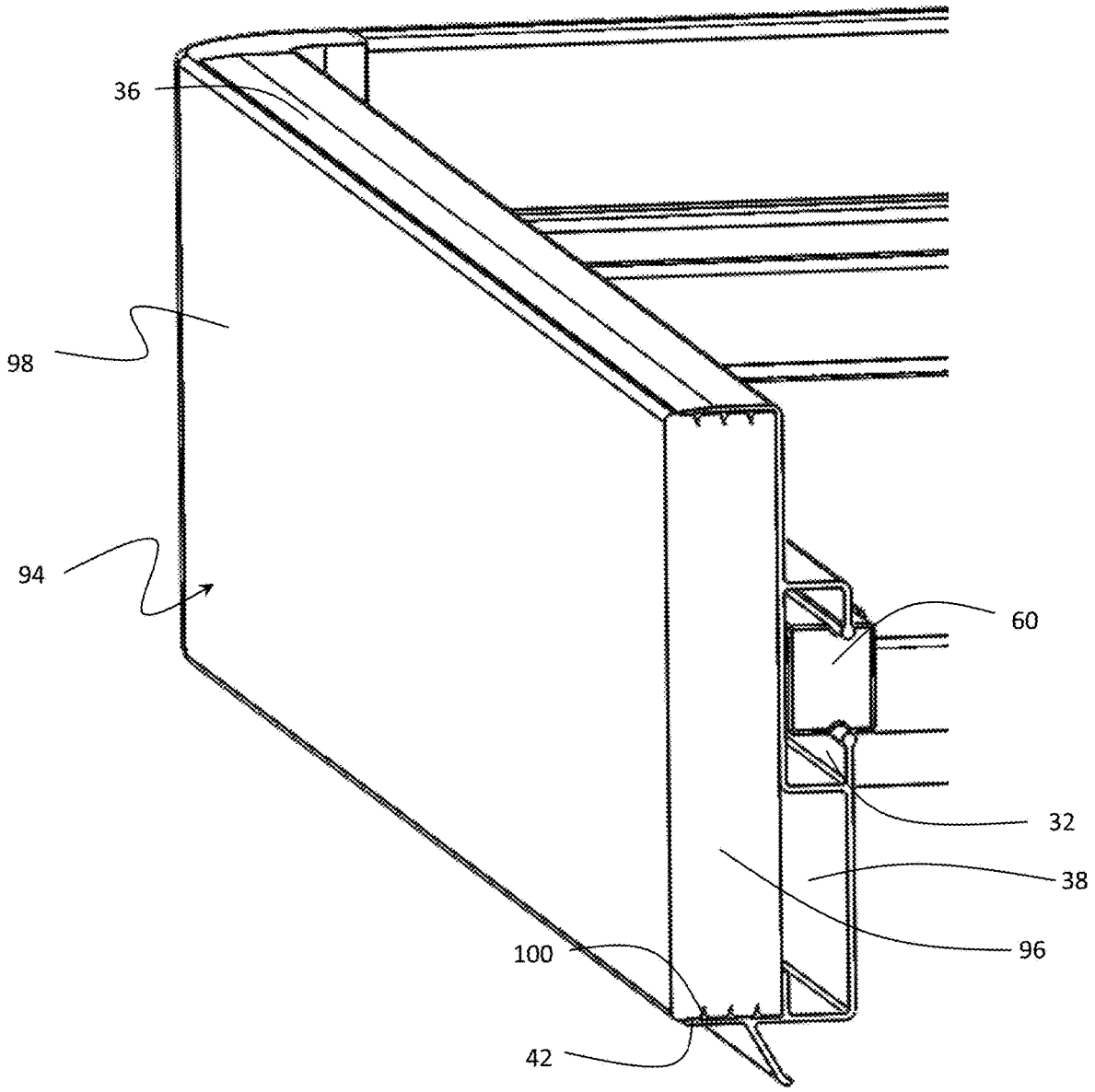
FIG. 11B is an end section isometric view showing the first structural frame extrusion with a foam bolster element inserted in the bolster flanges.

The frame 20 provides for integral finishing capability for a complete upholstered bed frame. As shown in FIGS. 11A and 11B, a padded bolster 94 surrounding the frame is created by inserting extruded foam blocks 96, which may be covered with a fabric outer layer 98, between the upper gripping flange 36 and lower gripping flange 42 of the first embodiment of the extrusion 24 as described with respect to FIGS. 2A and 2B. Upper gripping flange 36 and lower gripping flange 42 employ teeth 100 to engage the upholstered foam block 96. Fabric texture and color as well as shaping of the bolster based on the extrusion shape of the foam block may be selected at the time of installation of the bolster on the frame thereby providing great flexibility in product appearance.

Figure 11C:
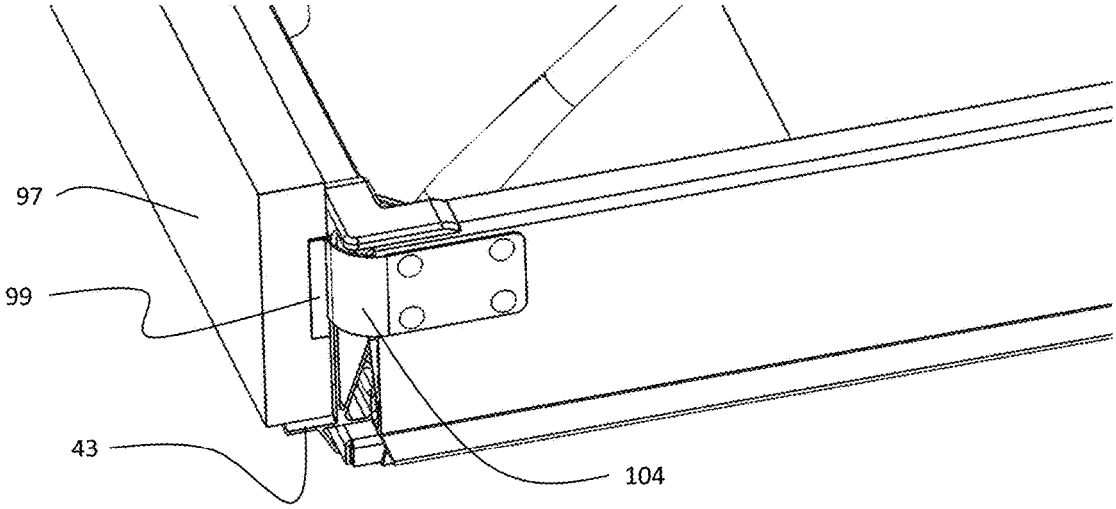
FIGS. 11C and 11D are end section perspective view showing the second structural frame extrusion with a foam bolster element attached to the extrusion with and without the corner bracket.
Figure 11D:
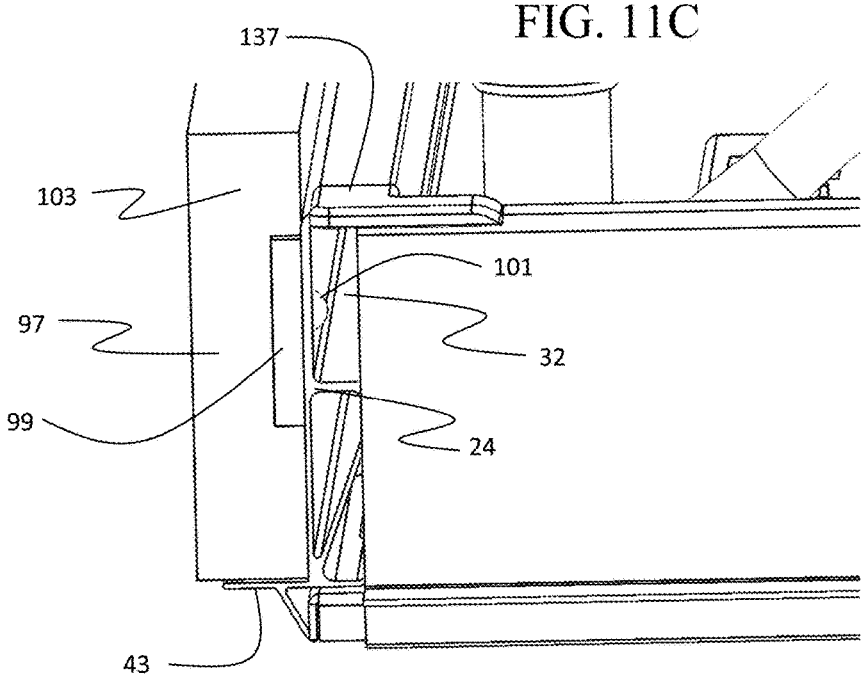

In alternative embodiments an adhesive or mechanical fasteners may be employed to secure the bolster. As an example shown in FIGS. 11C and 11D employing the extrusion 24 as described with respect to FIGS. 2C and 2D, a bolster 95 may employ an extruded foam block 97 in which a mounting support 99 is incorporated. The bolster rests on lower flange 43. The mounting support 99 may then be attached to the extrusion 24 using mechanical fasteners such as screws 101 extending through the outer flange 34 of the support channel 32. With the second embodiment of the extrusion 24 in which the outer flange 34 terminates at the upper extent of the support channel 32, the bolster 95 provides a resiliently flexible spacer 103 extending above the rigid elements of the extrusion (as best seen in FIG. 11D) to provide pinch protection where the articulating structure may rest on the top of the frame in the unarticulated position as disclosed in U.S. Pat. No. 8,990,983 entitled Bed Frame for an Adjustable Bed, having a common assignee with the present application.

Figure 12A:
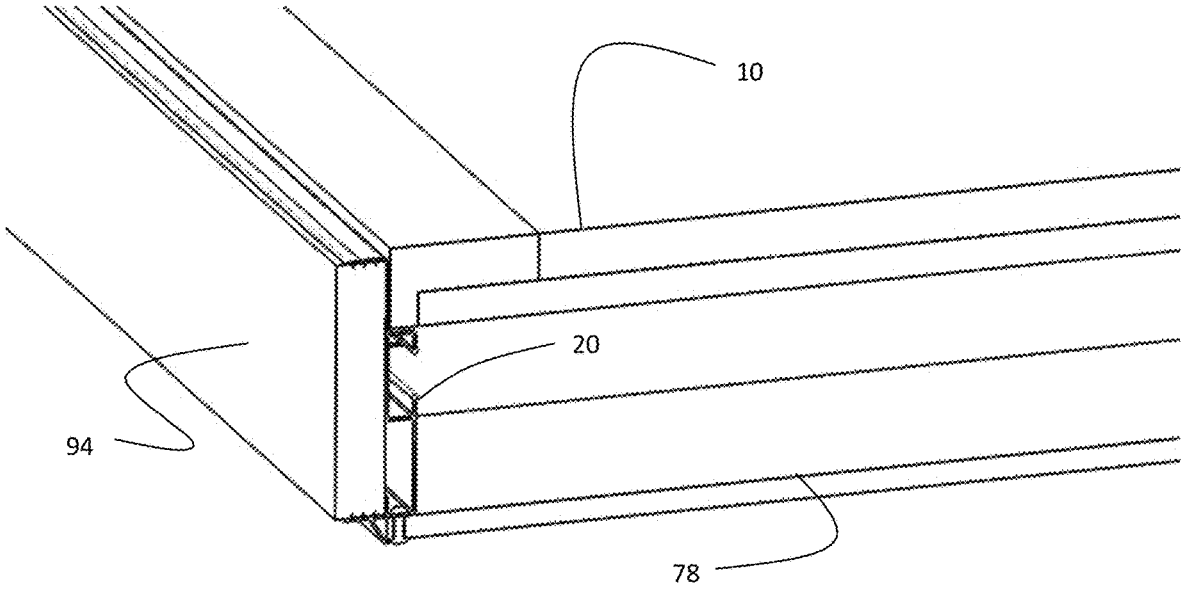
FIG. 12A is a section perspective view of the bolster element as inserted in the bolster flanges and the articulating structure in an unarticulated position flush with the structural frame.
Figure 12B:
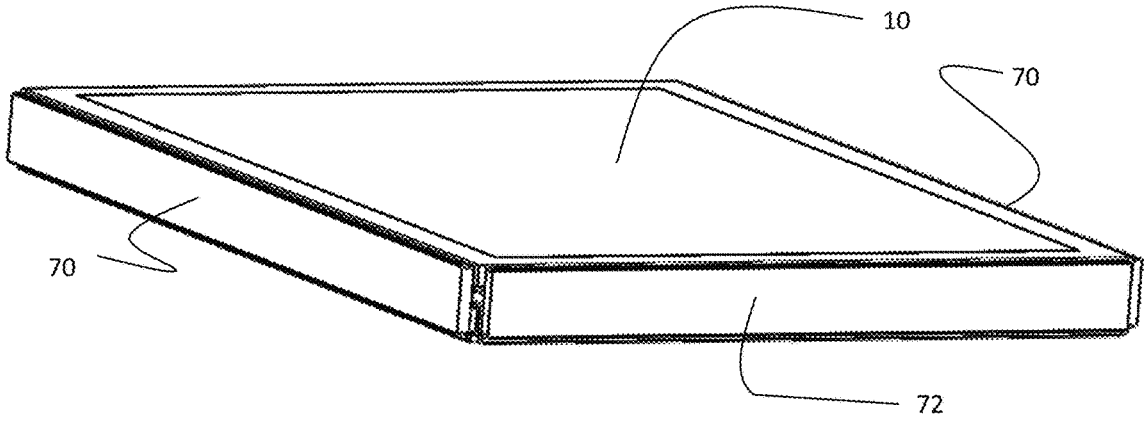
FIG. 12B is a partial perspective view showing a corner of the finished bed frame with the upholstered bolster.

As shown in FIGS. 12A and 12B, the completed frame 20 provides an attractive completed piece of bedroom furniture. The articulating structure 10 is supported by the frame 10 and, for the embodiment shown, is carried with all elements recessed flush with the upper extent of the frame.

Figure 13A:
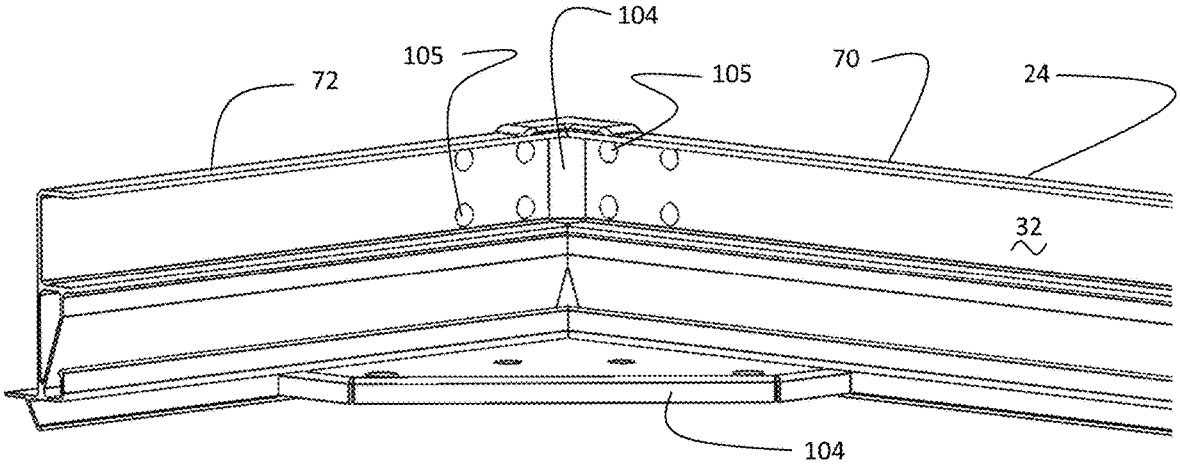
FIG. 13A is a perspective interior view of an assembled frame employing extrusions as described with respect to FIGS. 2C and 2D.
Figure 13B:
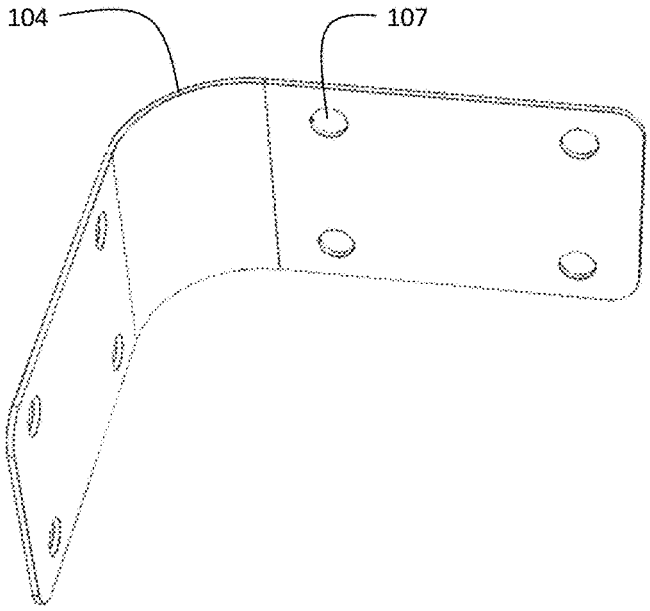
FIG. 13B is a perspective view of a corner bracket for the assembly shown in FIG. 13A.
Figure 13C:
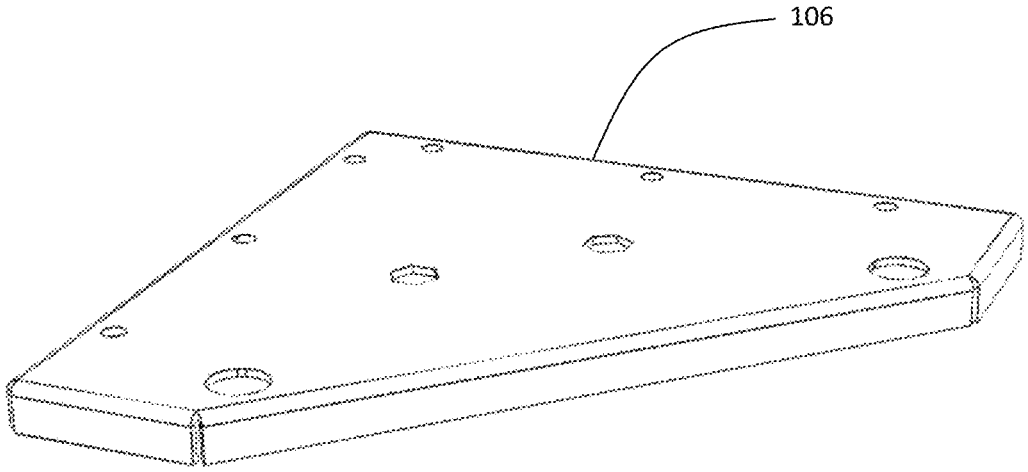
FIG. 13C is a perspective view of a bottom bracket and leg support for the assembly shown in FIG. 13A.

For embodiments of the frame wherein the frame side and end sections are cut as individual pieces, the frame is easily assembled employing corner brackets as shown in FIGS. 13A-13C. An assembled frame employing extrusions as described with respect to FIGS. 2C and 2D is shown in FIG. 13A. As shown, side elements 70 are connected to end elements 72 with a corner bracket 104 as shown in FIG. 13B and seen in FIG. 11C using fasteners 105 received through holes 107. For the embodiment shown, the corner bracket 104 has a filleted corner to accommodate a rounded corner on the bolster 95. While the embodiment shown places bracket 104 on the exterior wall of extrusion 24 in side elements 70 and end elements 72, the bracket may be received internally in the channel 32.

A bottom bracket and leg support 106 shown in FIG. 13C may be employed to provide additional rigidity in the corner of the assembled side elements 70 and end elements 72 as seen in FIG. 13A. Fasteners may be inserted through lower flange 43 or bottom flange 44 (as described with respect to FIGS. 2C and 2D) and holes 108 to engage the bottom bracket and leg support to the frame extrusions. The frame 20 may then be supported by legs attached to the bottom bracket and leg support 106.

The embodiments for the frame 22 as disclosed provide for a highly simplified manufacturing process with minimal tooling, specialty part numbers and skilled labor requirements. The extruded beam 24 may be received in long lengths or operated on directly from the extruder with a length of beam cut for a desired bed size as shown in FIG. 3A. Saw kerfs 52 are cut at the predetermined lengths for the side and end elements of the frame for the desired bed size. Each beam may then be powder coated and oven cured, or anodized or otherwise provided with a desired finish in a direct lineal process.

Figure 14A:
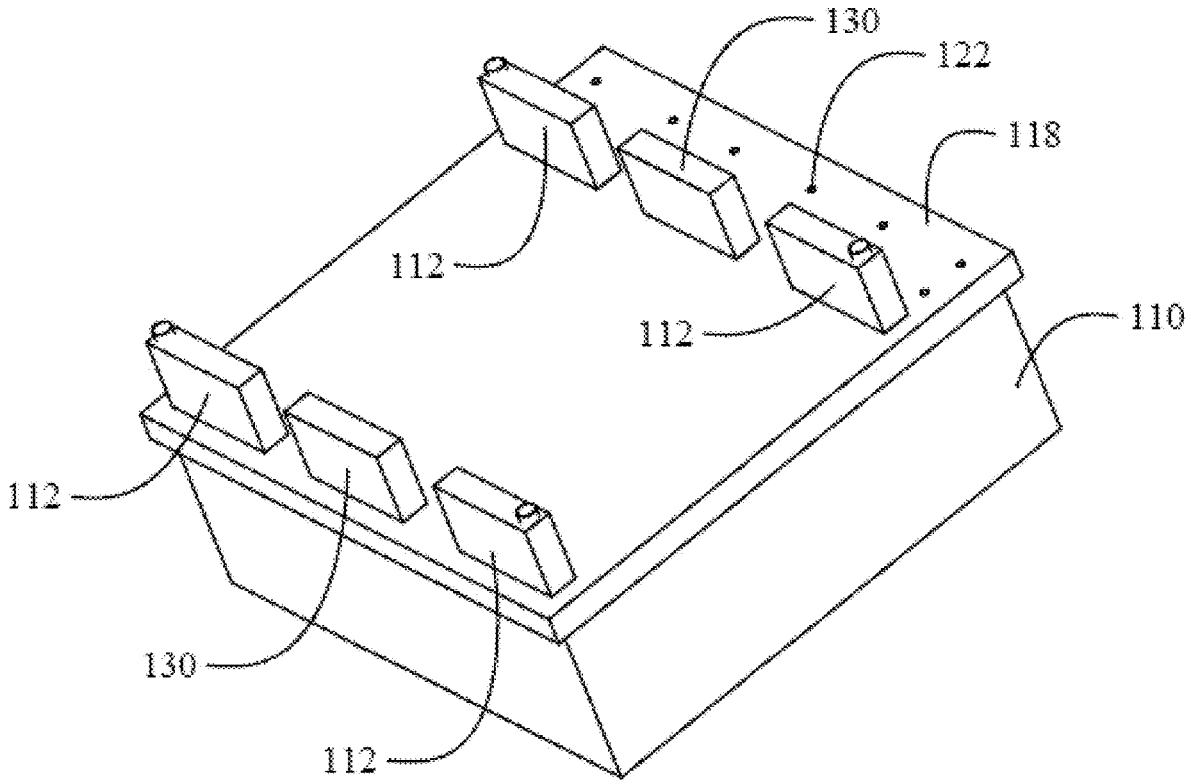
FIG. 14A is a perspective view of an assembly table for fabricating a bed frame employing the kerfed structural frame extrusions.
Figure 14B:
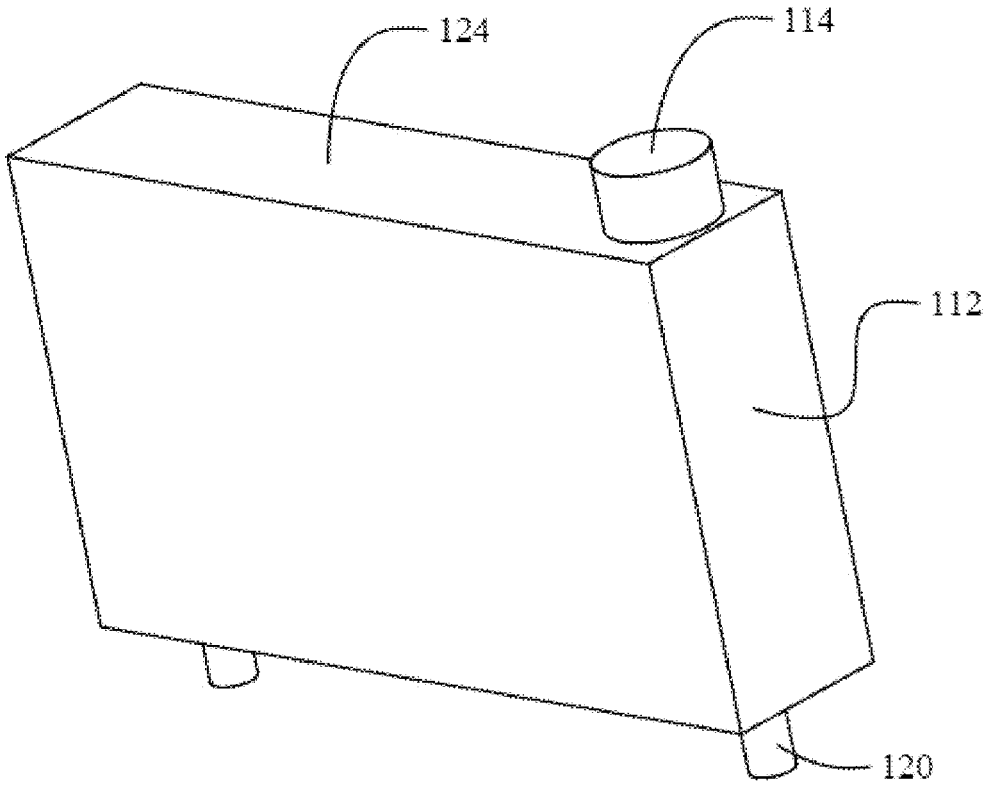
FIG. 14B is a perspective view of exemplary corner support elements for the assembly table.
Figure 15A:
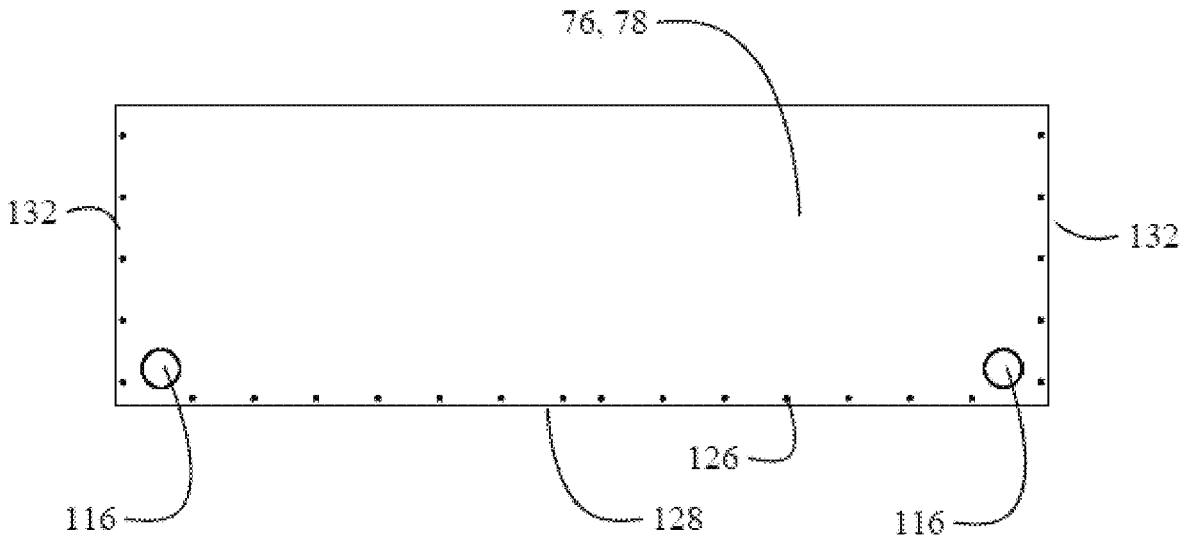
FIG. 15A is a top view of an example base element for the bed frame.
Figure 15B:
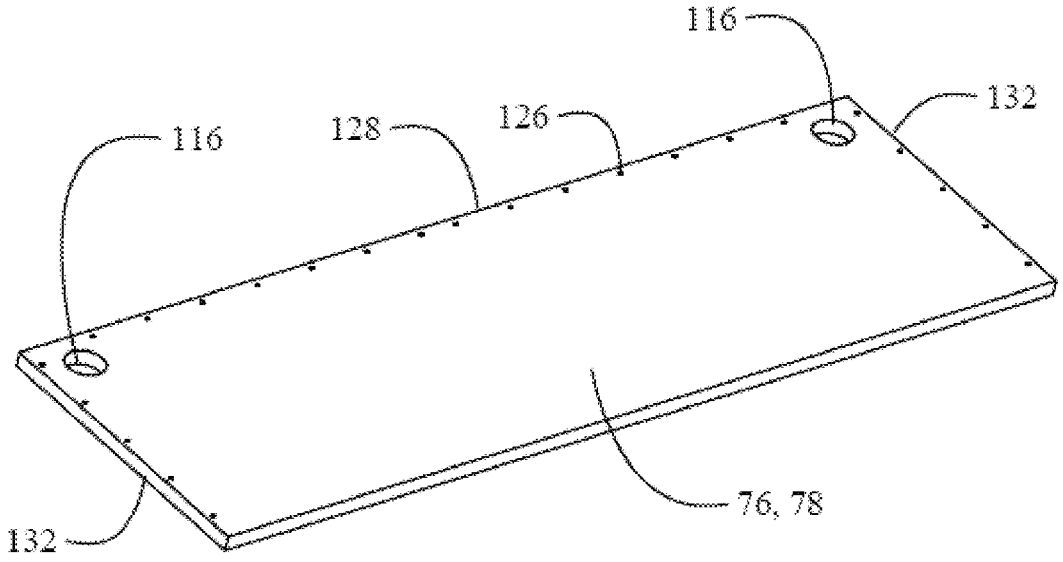
FIG. 15B is a perspective view of the base element.

Fabrication of the frame 20 for embodiments employing the saw kerf configuration described with respect to FIGS. 3A, 3B, 4A and 4B may be accomplished on a single forming tool 110 as shown in FIG. 14A. End blocks 112, shown in detail in FIG. 14B are placed on the tool 110 in corner position corresponding to the corners of the completed frame 22. The end blocks 112 incorporate positioning discs 114 which receive corresponding positioning holes 116 in the head end plate 76 and foot end plate 78 which are shown in detail in FIGS. 15A and 15B. For an exemplary embodiment, the end plates 76, 78 are fabricated from plywood and may be precision cut to length and width on a CNC saw or milling machine and the positioning holes 116 bored to match the positioning discs on the end blocks 112 of tool 110. As seen in FIGS. 14A and 14B, end blocks 112 are mounted to a top plate 118 on the tool 110 with dowels 120 received in sizing holes 122. Various bed widths, twin, double, queen or king may be accommodated by positioning of the dowels in the desired width sizing holes 122. An upper surface 124 on the end blocks 112 provides stable horizontal support for the end plates 76, 78. As a part of the CNC forming process for the end plates 76, 78 precision fastener holes 126 may be drilled.

Figure 16A:
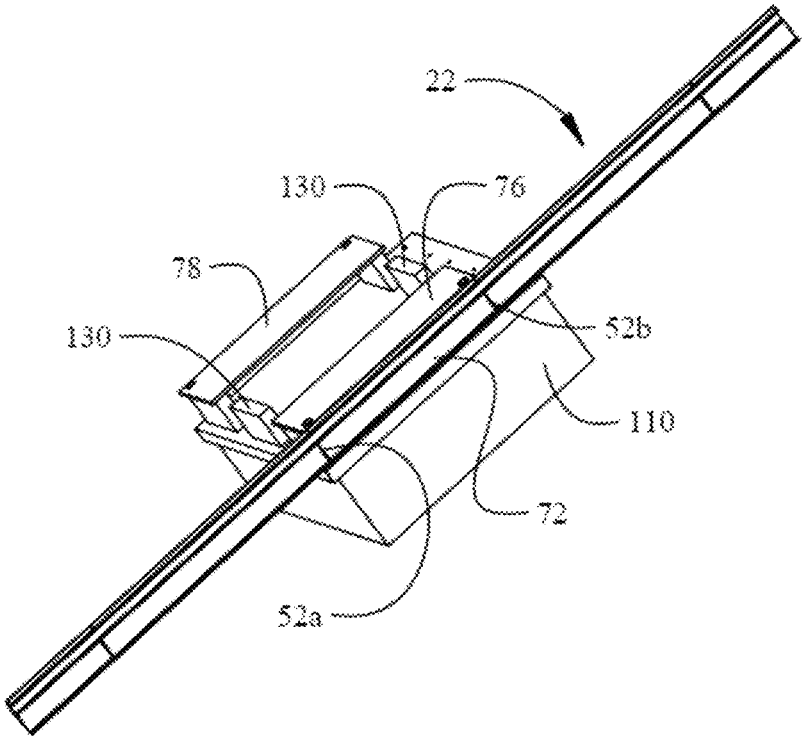
FIG. 16A is a perspective view of the assembly table with base elements installed and the kerfed structural frame extrusion positioned for assembly.
Figure 16B:
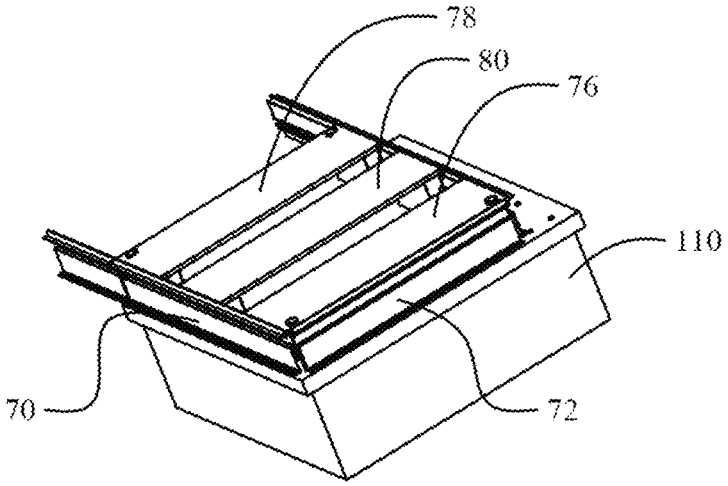
FIG. 16B is a perspective view of showing the structural frame extrusion bent to create the frame sides.
Figure 17:
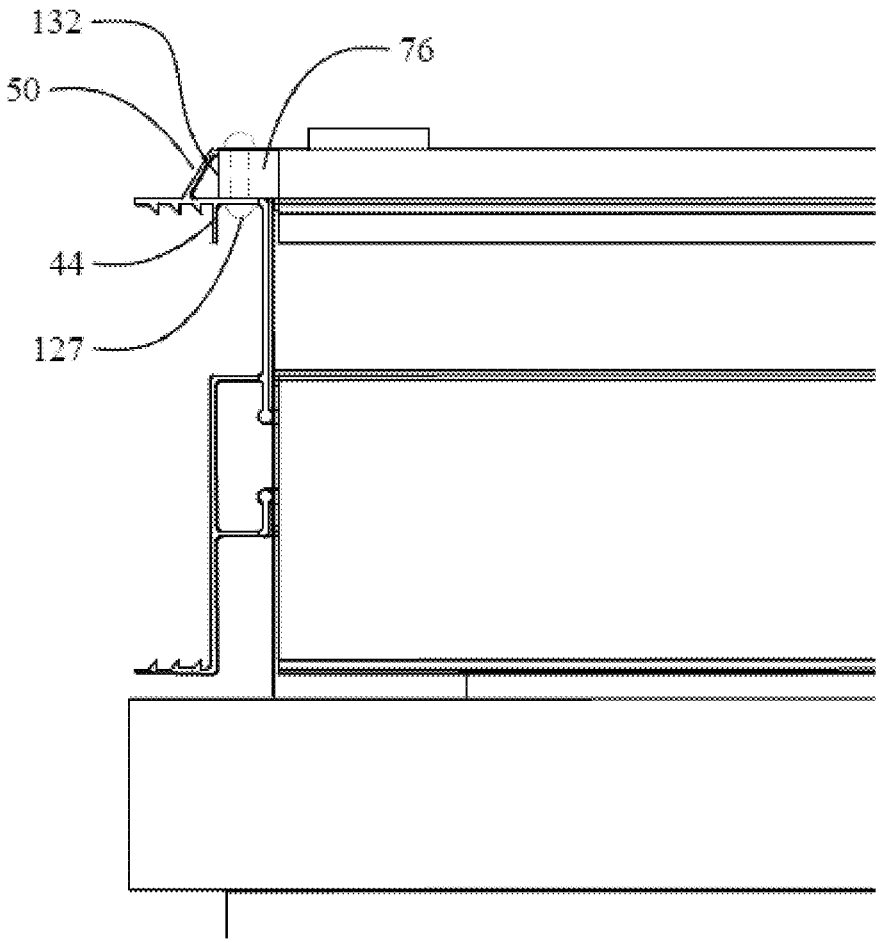
FIG. 17 is a detailed partial view showing the frame extrusion 22 as bent and mounted to the end plate with the feeler flange engaging the edges of the end plate.

With the end plates 76, 78 mounted on the tool 110 as shown in FIG. 16A, the extrusion 22 is aligned with an end element 72 positioned with kerfs 52*a* and 52*b* at the corners of the end plate 76. Feeler flange 50 is urged against an end edge 128 of the end plate 76 (seen in FIG. 15A) and fasteners are installed along that edge to engage the bottom flange 44 with the end element. Side elements 70 are then created by bending the extrusion 22 at the kerfs 52*a* and 52*b* at 90° as seen in FIG. 16B. Central plate 80 may be installed on center blocks 130 on the tool 110 prior to bending the side elements 70. The feeler flange 50 of the side elements 70 of the extrusion 22 are urged against side edges 132 of the end plate 76 (seen in FIG. 15A), central plate 80 and end plate 78 and fasteners 127 are installed along those edges to engage the end plate to the bottom flange 44. The attachment configuration is shown in FIG. 17 in detail.

A frame 20 may also be fabricated with side elements 70 and end elements 72 cut to length from extrusions 24 without leaving webs for bending of the elements. Side elements 70 and end elements 72 are aligned at the corners with feeler flanges 50 (as described with respect to FIGS. 2C and 2D) engaged against the end edges of the end plates 76, 78 and central plate 80 for installation of fasteners 127 and the corner brackets 104 as described with respect to FIGS. 13A and 13B may be installed to complete the rigid frame 20.

Translating support blocks 60, locked support blocks 82, and angled support members 88 may then be inserted into the support channels 32 in the frame side elements 70. Non-translating blocks or members may then be secured at predetermined locations. For finalizing assembly with completely separated end and side elements, the second end element is then installed and secured. For the extrusions having bendable saw kerfs, the frame 20 may then be removed from the tool 110 and the extrusion 22 may then be bent at kerfs 52*c* and 52*d* to close the frame with the frame end elements 72*a* and 72*b* engaging the end plate 78 with feeler flange 50 urged against the end edge 128 of the end plate 78 and fasteners are installed along that edge to engage the bottom flange 44 with the end element. As previously described and shown in FIG. 10C, an angled support block may be employed to provide additional rigidity by engagement across the support channels 32 of the abutting frame end elements 72*a* and 72*b*. Actuation elements for the articulating structure 10 and the chariot 22 may then be installed on into the blocks or onto the central plate or end plates as appropriate and the articulating structure mounted to the chariot and actuating elements.

Figure 18:
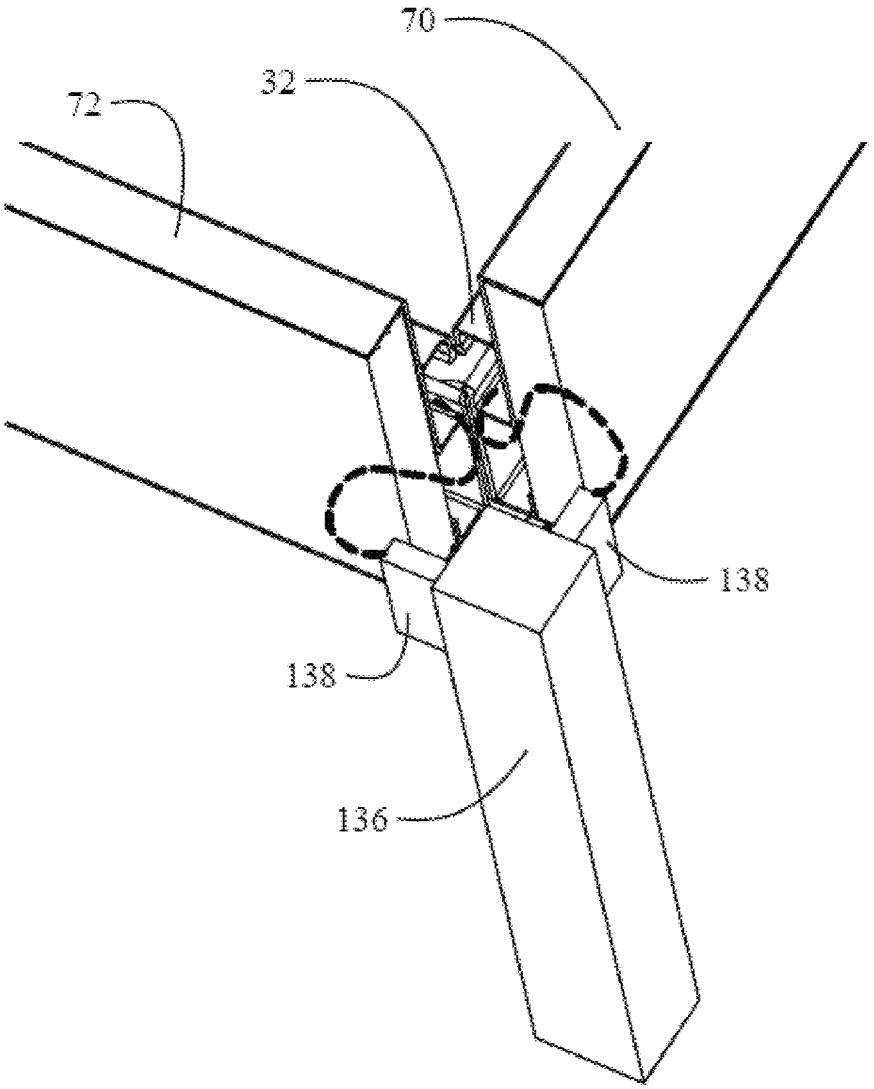
FIG. 18 is a partial perspective view of an exploded corner element for finishing the bolster.

The bolster for the bed may be fabricated in a similar linear process to the frame extrusion with the extruded foam which may be expanded polyethylene (EPE) or similar material may be provided in long lengths or operated on directly out of the extruder. A total length for the bolster may be cut and kerfs created for bending the bolster at the frame corners. Geometry for the kerfs to provide bent curves at the corners may be employed as described in previously referenced copending application Ser. No. 12/942,916 entitled Bed Frame for an Adjustable Bed, having a common assignee with the present invention. Fabric may be applied to the EPE foam in an adhesive roll process or alternative spray finishes may be applied to the foam. The kerfed foam is then inserted into the gripping flanges 36 and 42 on the extrusion 22. Alternatively, the covered foam may be cut into lengths corresponding to the frame side elements 70 and end elements 72 and separately installed on each element. Corner finishing elements 136 which may include the legs for the bed may then be secured in the corners by inserting capture flanges 138 into the exposed accessory channel or support channel 32 as shown in FIG. 18. The corner finishing element may be a top cap 137 merely provide continuity of the flange of the support channel around the corner as shown FIG. 11C.

Figure 19:
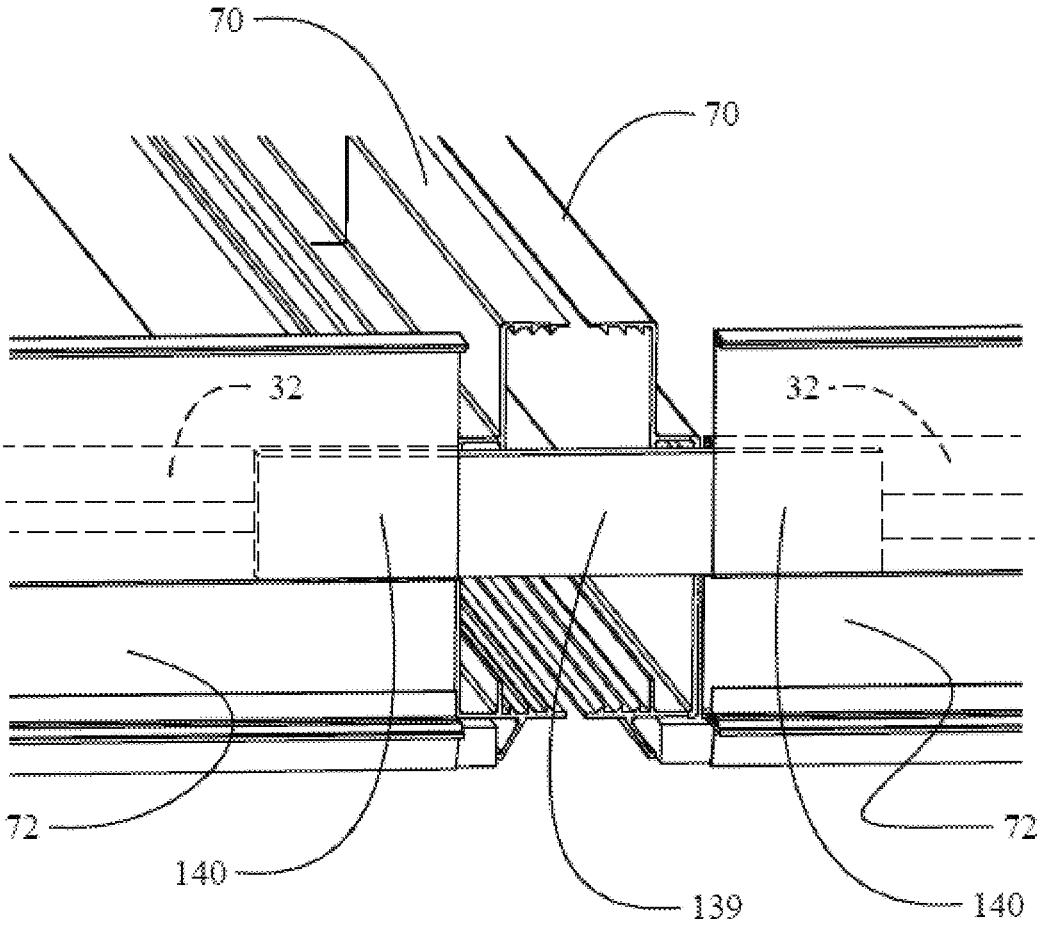
FIG. 19 is a partial perspective view showing joining of frames using engagement flanges in the support channel of adjacent frames for a paired king bed assembly.
Figure 20:
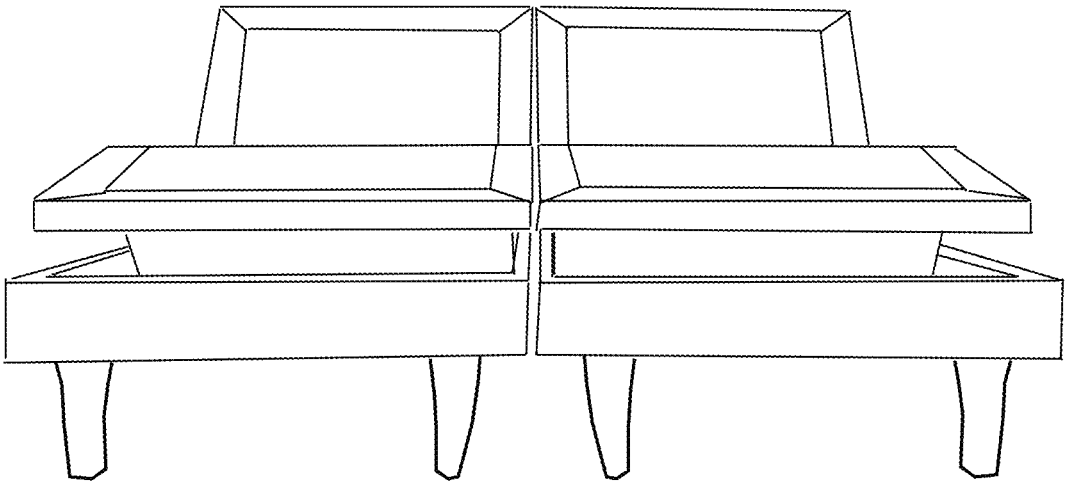
FIG. 20 Prior Art
FIG. 20 is a pictorial view of prior art assembly of two twin bed frames to form a king sized bed.
Figure 21:
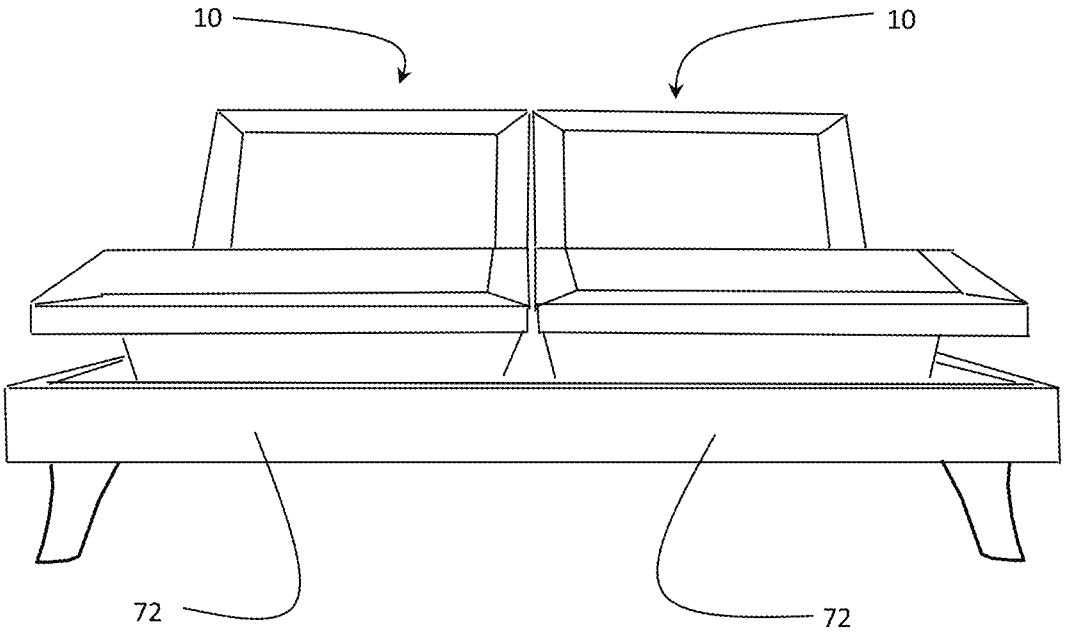
FIG. 21 is a pictorial view of the current frame assembly allowed by joining with engagement flanges as shown in FIG. 19 with a continuous bolster assembly.

Similarly, bed frames 10 may be physically joined by employing a joining splice 139 having flange elements 140 engaged into the exposed support channels 30 of the end elements 72 in adjacent frames as shown in FIG. 19. This allows joining of frames with separate articulating structures into a single bed, for example, in a king bed size having two twin sized articulating assemblies and frames. The prior art requirement for multiple legs as shown in FIG. 20 is now eliminated allowing a king created from paired twins as shown in FIG. 21.

Figure 22A:
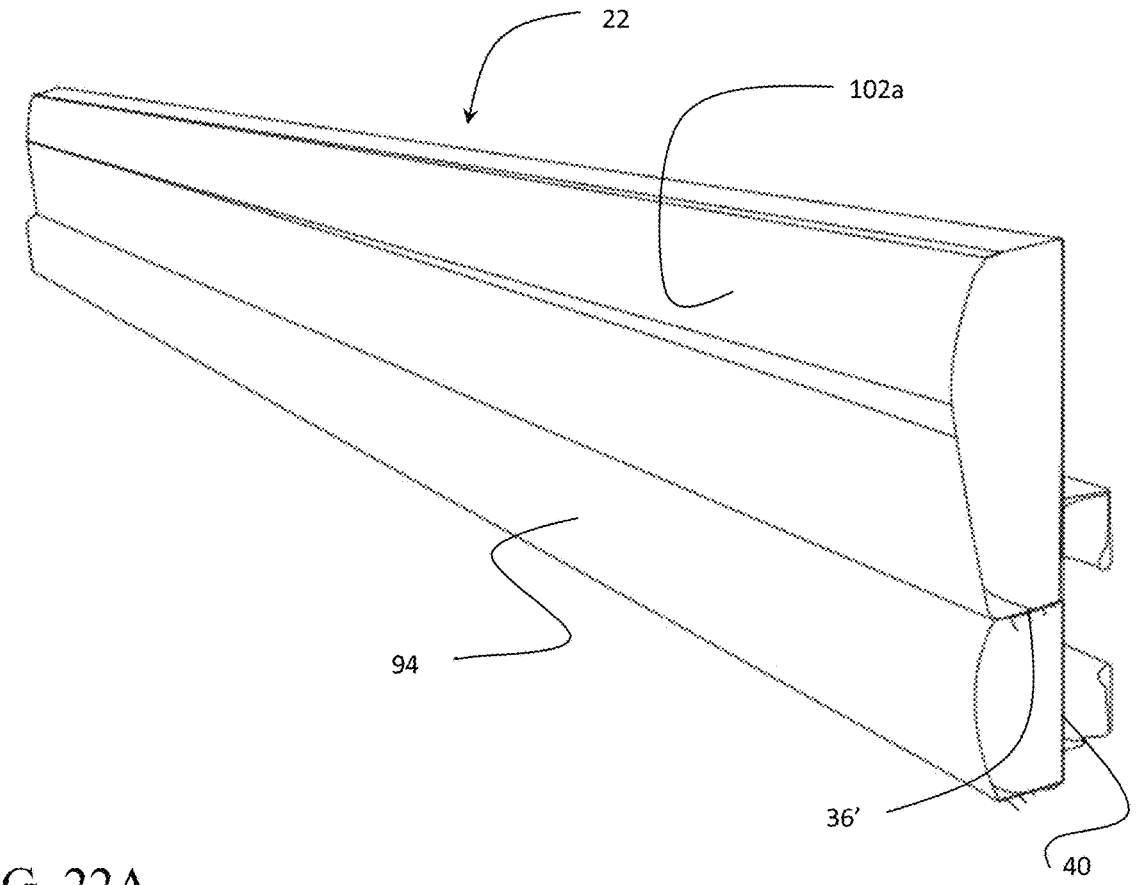
FIGS. 22A-C are a pictorial views of an alternative embodiments of the extrusion for exterior finish; and, FIG. 23 is a pictorial view of a bracket engaging the support channel for mounting of a headboard.
Figure 22B:
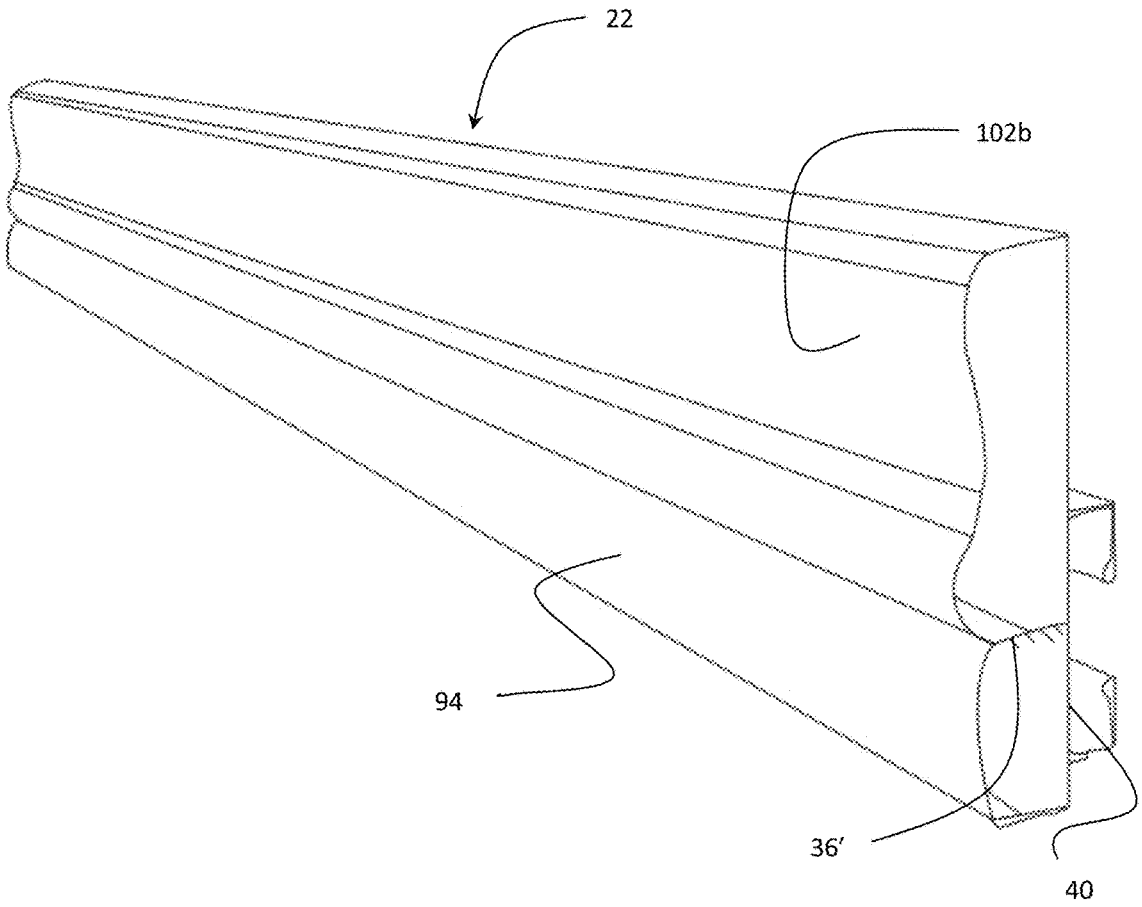
Figure 22C:
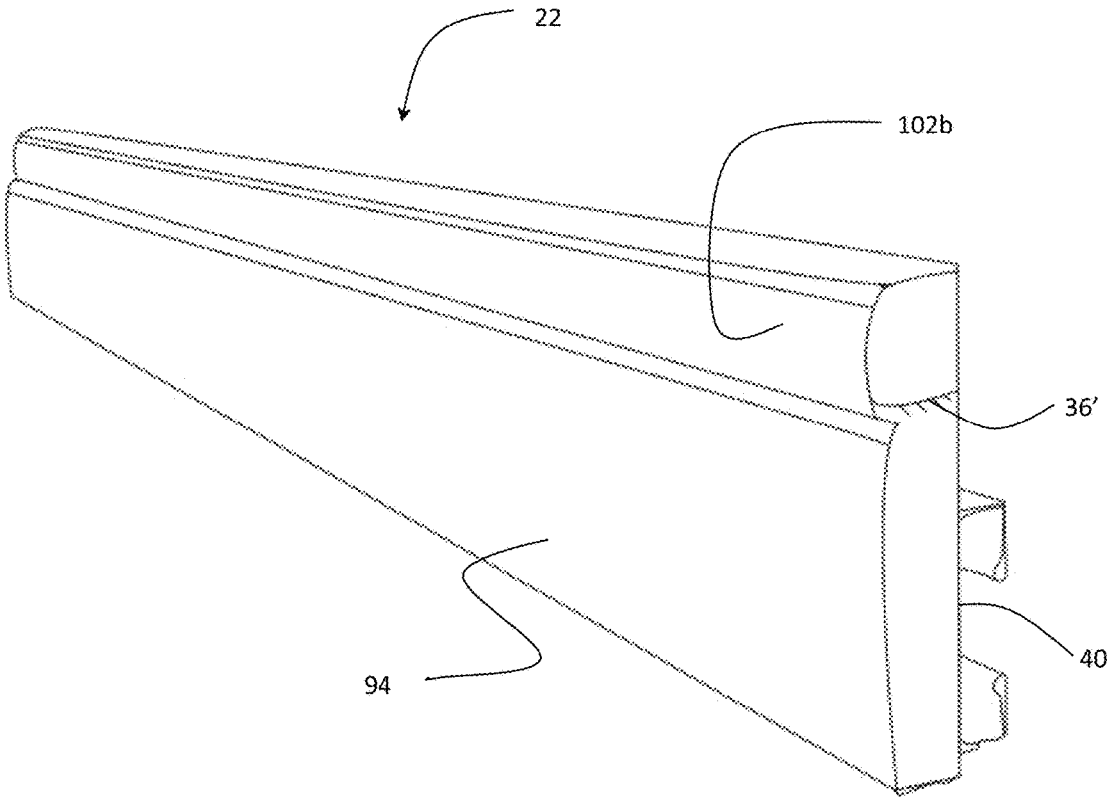
Figure 22D:
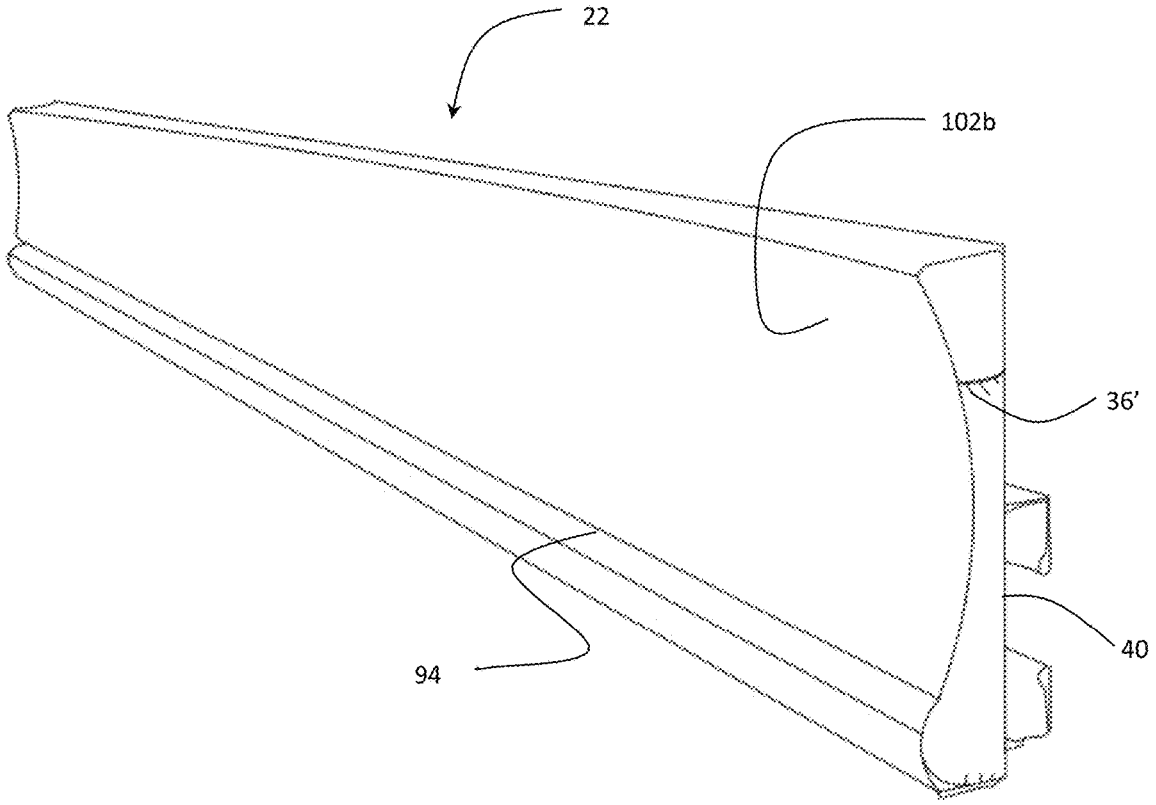

The extrusion 22 may additional include formed elements to provide a finished surface on a portion or the entire external surface of the frame. As shown in FIGS. 22A and 22B, the upper grasping flange 36' may extend from an intermediate point on the outer flange 40 and a finished box element 102*a* or 102*b* may be included in the extrusion providing a substantially finished surface for at least a portion of the frame. The relative height of the finished box element and fabric padded bolster 94 may be adjusted by positioning of the upper grasping flange 36' as desired as shown in FIG. 22C or FIG. 22D.

Figure 23:
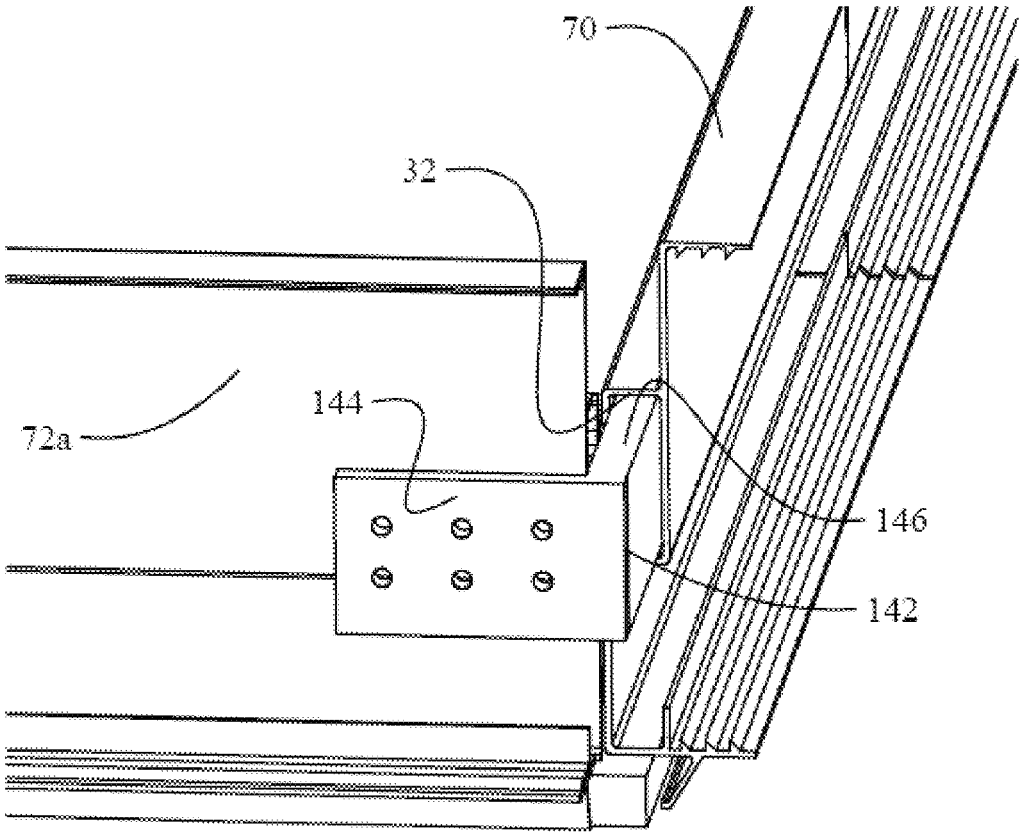

Attachment for a head board on the bed is also easily accommodated as shown in FIG. 23. An engagement angle 142 is inserted into the open head end of the support channels 32 in the frame side elements 70 and secured using dimpling screws or similar means as previously described for the fixed elements. A mounting plate 144 extends perpendicular to the insertion flange 146 for mounting of the headboard.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A frame for an articulating bed comprising:

an extruded beam having an inner flange, a bottom flange, a feeler flange extending from the bottom flange and a support channel formed therein, said extruded beam cut to form frame side elements and end elements;

a head end plate and a foot end plate, said head end plate and foot end plate engaged on and fastened to a bottom surface of the bottom flange and extending between the frame side elements, the feeler flange engaging side and end edges of the head end plate and foot end plate; and, a plurality of support elements received in and supported by the support channel, said support elements engaging a cradle supporting a seat section of an articulating structure.

2. The frame for an articulating bed as defined in claim 1 wherein the support elements are translatable within the support channel.

3. The frame for an articulating bed as defined in claim 1 wherein the extruded beam further includes an accessory channel.

4. The frame for an articulating bed as defined in claim 1 wherein the extruded beam further includes an upper gripping flange and a lower gripping flange and further comprising a foam bolster engaged between the upper gripping flange and lower gripping flange.

5. The frame for an articulating bed as defined in claim 4 wherein the foam bolster is fabric covered.

6. The frame for an articulating bed as defined in claim 1 wherein the extruded beam includes saw kerfs extending through the beam to the inner flange, said inner flange bent at the saw kerfs to form the side and end elements.

7. The frame for an articulating bed as defined in claim 1 further comprising a plurality of locked support blocks received in the support channel and engaging structural elements of the actuation system for the articulating structure.

8. The frame for an articulating bed as defined in claim 1 further comprising a foam bolster engaged on the bottom flange, said foam bolster incorporating a mounting support fastened to the extruded beam with a resilient flexible spacer extending above the support channel.

9. A method for fabrication of a frame for an articulating bed comprising:

forming an extruded beam having an inner flange, a bottom flange, a feeler flange extending from the bottom flange and a support channel formed therein, said extruded beam cut to form frame side elements and end elements;

introducing saw kerfs in the extruded beam to form side and end elements;

mounting foot and head end plates on a tool;

engaging the feeler flange of the extruded beam with an end element against an end edge of the foot end plate;

bending the side elements at a first two saw kerfs to engage side edges of the foot and head end plates with the feeler flange and fastening the foot end plate on the bottom flange with the foot and head end plates extending between the side elements forming a frame assembly;

removing the frame assembly from the tool;

inserting translating support blocks into support channels in the extruded beam;

closing the end elements at the head end plate by bending at two remaining saw kerfs to engage the feeler flange on a head end edge and fastening head end plate on the bottom flange;

mounting a chariot to the translating support blocks; and, mounting an articulating structure to the chariot.

10. The method as defined in claim 9 further comprising:

inserting fixed support blocks in the support channels;

securing the fixed support blocks; and, mounting actuation elements for the articulating assembly to the fixed support blocks.

11. The method as defined in claim 9 further comprising:

mounting a central plate on the tool;

engaging the central plate with the side elements of the extruded beam during bending of the side elements; and, mounting actuation elements for the articulating assembly to the central plate.

12. The method as defined in claim 9 further comprising:

engaging a bolster between gripping plates in the extruded beam.

13. The method as defined in claim 12 further comprising:

extruding the bolster from rigid foam; and, covering the foam with a fabric outer layer.

14. The method as defined in claim 9 further comprising:

engaging end and side surfaces of the end plates with feeler flanges on the extruded beam; and, fastening the extruded beam to the end plates.

15. The method as defined in claim 9 further comprising joining two frames by inserting joining flange elements into exposed support channels.

* * * * *